US008220405B2

(12) United States Patent
Christensen et al.

(10) Patent No.: US 8,220,405 B2
(45) Date of Patent: Jul. 17, 2012

(54) WINCH SYSTEM SAFETY DEVICE CONTROLLED BY TOWROPE ANGLE

(75) Inventors: Ladd E. Christensen, Holladay, UT (US); John M. Welch, American Fork, UT (US); Tyson Triplett, Provo, UT (US); Devin J. Hales, Lehi, UT (US)

(73) Assignee: Global Innovative Sports Incorporated, Holladay, UT (US)

( * ) Notice: Subject to any disclaimer, the term of this patent is extended or adjusted under 35 U.S.C. 154(b) by 0 days.

(21) Appl. No.: 12/782,006

(22) Filed: May 18, 2010

(65) Prior Publication Data

US 2010/0224843 A1 Sep. 9, 2010

Related U.S. Application Data

(63) Continuation-in-part of application No. 12/621,442, filed on Nov. 18, 2009, which is a continuation-in-part of application No. 11/069,615, filed on Feb. 28, 2005, now Pat. No. 7,665,411.

(60) Provisional application No. 60/599,273, filed on Aug. 6, 2004.

(51) Int. Cl.
*B63B 21/16* (2006.01)

(52) U.S. Cl. ..... 114/254

(58) Field of Classification Search ..... 114/254; 441/69; 242/333, 413.3, 413.6, 904, 421.7
See application file for complete search history.

(56) References Cited

U.S. PATENT DOCUMENTS

| | | | | | |
|---|---|---|---|---|---|
| 3,261,302 | A | * | 7/1966 | Forsman | 105/148 |
| 3,315,914 | A | * | 4/1967 | Turner | 242/390.1 |
| 4,237,999 | A | * | 12/1980 | Batreau | 182/19 |
| 4,624,141 | A | * | 11/1986 | Soleau | 73/865.8 |
| 5,408,221 | A | * | 4/1995 | Carsella et al. | 340/604 |
| 5,694,337 | A | * | 12/1997 | Macken | 700/91 |
| 6,102,373 | A | * | 8/2000 | Amsinger | 256/1 |

* cited by examiner

*Primary Examiner* — Stephen Avila
(74) *Attorney, Agent, or Firm* — Steven L. Nichols; Van Cott, Bagley, Cornwall & McCarthy P.C.

(57) ABSTRACT

A towrope winch with a safety shutoff device includes a winch configured to wind a rope; and a safety shutoff device which deactivates the winch if the rope moves outside a designated range of angles relative to an intake of the winch.

19 Claims, 22 Drawing Sheets

WINCH SYSTEM SAFETY DEVICE CONTROLLED BY TOWROPE ANGLE

RELATED APPLICATIONS

The present application claims the benefit under 35 U.S.C. §119(e) of Provisional U.S. patent application Ser. No. 60/599,273, filed Aug. 6, 2004, and further claims the benefit under 35 U.S.C. §120 of Utility application Ser. No. 11/069,615, filed Feb. 28, 2005, now U.S. Pat. No. 7,665,411, and Utility application Ser. No. 12/621,442, filed Nov. 18, 2009. These applications are incorporated herein by reference in their entirety.

BACKGROUND

Water sports such as wakeboarding, wakeskating, skurfing, wake surfing, and knee boarding have become increasingly popular. Due to the popularity of such water sports, new technology has been developed to enhance the participant's experience.

Particularly, several measures have been taken to increase the size of the wake made by the watercraft that is towing a wake boarder or other type of water sport enthusiast, such as a wake skater, wake surfer, or tuber. The size of the wake, which is the track left by a moving watercraft in the water, can determine how enjoyable the experience is for the user being towed. The higher and more voluminous the wake is, the greater vertical lift a wake boarder or watercraft sport enthusiast can achieve when moving over and springing off of the wake. With this greater vertical lift, the user can perform tricks and stunts that would not be possible with a smaller wake.

One way in which the wake is made bigger is by adding large amounts of weight to the boat or watercraft. This is often achieved by adding a water ballast system to the inside of the watercraft. A water ballast system will take on water when desired to cause the watercraft to ride lower and sink farther into the water, in other words, to increase the draft of the watercraft. When the watercraft then moves through the water, the increased draft causes the resulting wake to be larger.

While a ballast system does make a larger wake and does make it possible for the user to gain greater lift from the wake, it also has several disadvantages. For example, a ballast system causes the watercraft to experience a drastic decrease in fuel efficiency and handling, and creates all around greater wear and tear on the watercraft's mechanical parts.

In addition, ballast systems are generally only available in newer watercraft for the purpose of increasing wake size. Older watercraft do not have such ballast systems, and ballast systems are extremely difficult to retrofit to older watercraft. When a ballast system is added to an older watercraft, the result is usually not cost effective and outweighs the advantages of a having a larger wake obtained through installing such a ballast system.

Another way in which a user can enhance the vertical lift he or she can achieve over the wake of a watercraft is to include a tower on the watercraft. The towrope is then attached to the top of the tower. By increasing the distance between the surface of the water and the point at which the towrope is attached to the watercraft, the skier or boarder being towed can exert force, pulling upward on the towrope to achieve a greater vertical lift over the wake. The tower is typically a pylori or framework usually made of aluminum or other light metals.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Figure 1:
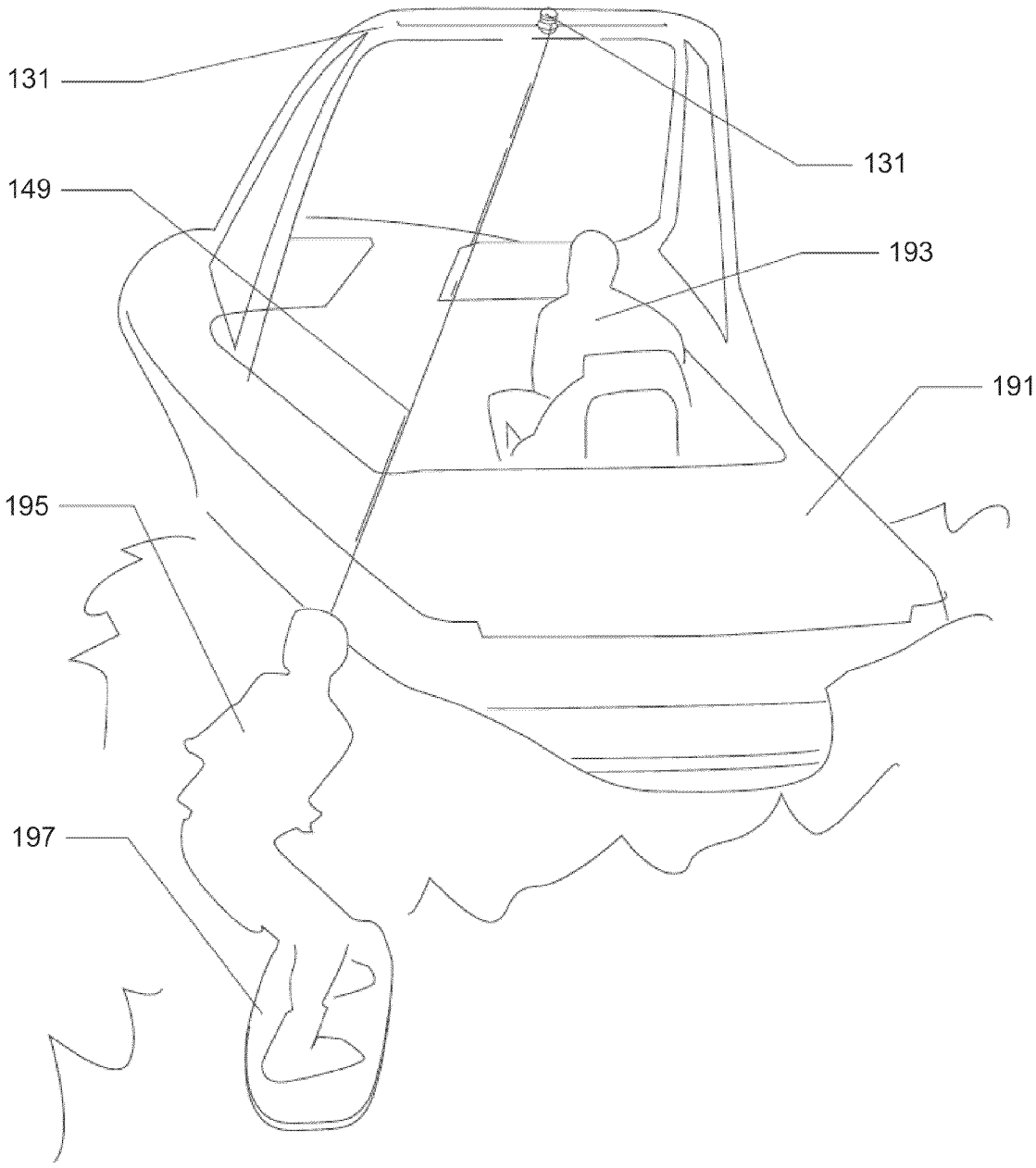
Prior Art Fig. 1
FIG. 1 is an illustrative depiction of a watercraft and towrope system according to teachings of the prior art.

As described in detail below, the present specification describes a system in which a winch is used to selectively accelerate a board rider being towed by a watercraft. In order to do so safely, various systems and methods for safely controlling a tow system that includes a towrope winch on a watercraft are disclosed herein. Tension on the towrope of such a system might be applied from outside the watercraft by a board rider, in which case the winch should be operative for the rider. On the other hand, tension on the towrope may be applied, perhaps unintentionally, from inside the watercraft, in which case the winch should be inoperative for safety reasons. Therefore, the system is made safer by determining the angle at which tension is applied to the towrope and only enabling the winch when that angle is within a range indicating use by a rider from outside and to the rear of the watercraft as opposed to tension from inside or toward the front of the watercraft.

Consequently, a safety switch is used to disable operation of the winch system unless the towrope is actually in use with a rider being towed behind the watercraft. In some embodiments, the safety switch relies on the rope tension created by a rider within a specific range of angles, indicating that the tension is coming from outside the watercraft, to move a slider or rocker switch that then enables operation of the winch. In such examples, the absence of tension on the rope within a specified range of angles will allow the slider or rocker, under the influence of gravity, to move downward into an inoperative position. The slider or rocker may then interrupt power to the winch when allowed to move downward into the inoperative position.

Various embodiments of these principles will be described below in connection with the drawings. In general, one of these embodiments may be described as a towrope winch with a safety shutoff device including a winch configured to wind a rope; and a safety shutoff device which deactivates the winch if the rope moves outside a designated range of angles relative to an intake of the winch. The safety shutoff device deactivates the winch if the angle of the rope relative to the intake of the winch indicates that the rope is under tension from inside a watercraft on which the winch is located. The safety shutoff device enables operation of the winch if the angle of the rope relative to the intake of the winch indicates that the rope is under tension from outside a watercraft on which the winch is located. The designated range of angles includes a range of angles from 0 degrees to −75 degrees, with 0 degrees being parallel to a water surface on which a watercraft bearing said winch is floating.

The safety shutoff device may include a slider which is moved by the rope to activate or deactivate the winch depending on the angle of the rope relative to an intake of the winch. In some such examples, the slider closes a circuit to provide power to the winch if the rope is under tension and extending within the designated range of angles relative to an intake of the winch. The slider moves downward under influence of gravity to open said circuit if not moved by the rope. The slider may include a roller for engaging the towrope.

In other examples, the safety shutoff device may, include a biased switch which is actuated by the rope depending on the angle of the rope relative to an intake of the winch so as to activate or deactivate the winch. Alternatively, the safety shutoff device may include a light curtain for determining an angle at which said rope extends relative to an intake of the winch.

The safety shutoff device may deactivate the winch if a designated amount of tension is not applied to the rope.

The principles disclosed herein may also be embodied in a variety of methods, such as a method of operating a towrope winch with a safety shutoff device, where the winch is configured to wind a rope. Such a method may be described as, with the safety shutoff device, deactivating the winch if the rope moves outside a designated range of angles relative to an intake of the winch.

As used in the present specification and the appended claims, the term "watercraft" is meant to be understood broadly as any machine or device that may provide sufficient force to pull an object, including a rider, board, tube, etc. on water. A watercraft may include, for example, a personal watercraft (PWC), or a boat or ship of any kind. Further, as used in the present specification and the appended claims, the term "towrope" or "rope" is meant to be understood broadly as any rope, cable or the like attached to a watercraft, and used to pull any object, including a rider, board, tube, etc. behind the watercraft, and may be of any given length.

Still further, as used in the present specification and the appended claims, the term "board" is meant to be understood broadly as any object being utilized by a rider to plane on the surface of the water when being towed by a watercraft. Examples of a board may include skis, water skis, a wakeboard, a wakeskating board, a surfboard, a skurfing board, a kneeboard, a boogey board etc. Also, although a tube is not a board, per se, a tube and other devices may also be utilized by a rider to plane on the surface of the water when being towed by a watercraft.

Further, as used in the present specification and the appended claims, the term "winch" is meant to be understood broadly as any device that may change or adjust the length of rope between two points. An example of a winch is a rotary towrope winch used to change or adjust the length of the towrope between a watercraft and rider by winding or unwinding the rope with a rotating drum. As defined herein, a winch may also include a piston, lever or other device that may change or adjust the length of rope between two points. The winch "intake" will be understood to mean the aperture or area where the rope enters or attached to the winch.

Again, as used in the present specification and the appended claims, the term "tower" is meant to be understood broadly as any structure that extends above the deck of a watercraft to which a towrope is attached or belayed or to which a towrope winch is attached for the purpose of increasing the distance between the surface of the water and the connection point between the towrope and watercraft.

Further, as used in the present specification and the appended claims, the term "user interface" is meant to be understood broadly as any device, system of devices, computer code, or combinations thereof that may be utilized by a user in controlling the input and output of a computing system or other device. Examples of a user interface may include a graphical user interface (GUI), a keyboard, a mouse, a display device, a touch screen display device, a mobile telecommunications device, a personal digital assistant (PDA), a handheld computer, a laptop computer, a desktop computer, a web-based user interface, etc.

FIG. 1 is an illustrative depiction of a watercraft and towrope system according to teachings of the prior art. While a boat is illustrated as the watercraft (191) in FIG. 1, it will be understood that the principles described herein can be applied to any watercraft (191) that can tow a rider (195) and any board (197) on water. As shown in FIG. 1, a tower (131) may be disposed on the watercraft (191). The tower (131) is connected to the watercraft (191) so as to be structurally sound enough to tow one or more riders (197). The tower (131) is usually made of a strong, lightweight material, such as aluminum, and may be a single pylori or a frame as depicted in FIG. 1.

A towrope (149) is attached to the top of the tower (131) so as to be attached to the watercraft (191) at a relatively greater height above the surface of the water. The towrope (149) is attached to the top of the tower (131) by a hitch (132). The hitch (132) may be any apparatus that is configured to secure the towrope (149) to the tower (131), and may include, for example, a ball hitch, a cleat, a hook, a tow knob, or a ski tow eye.

Figure 2:
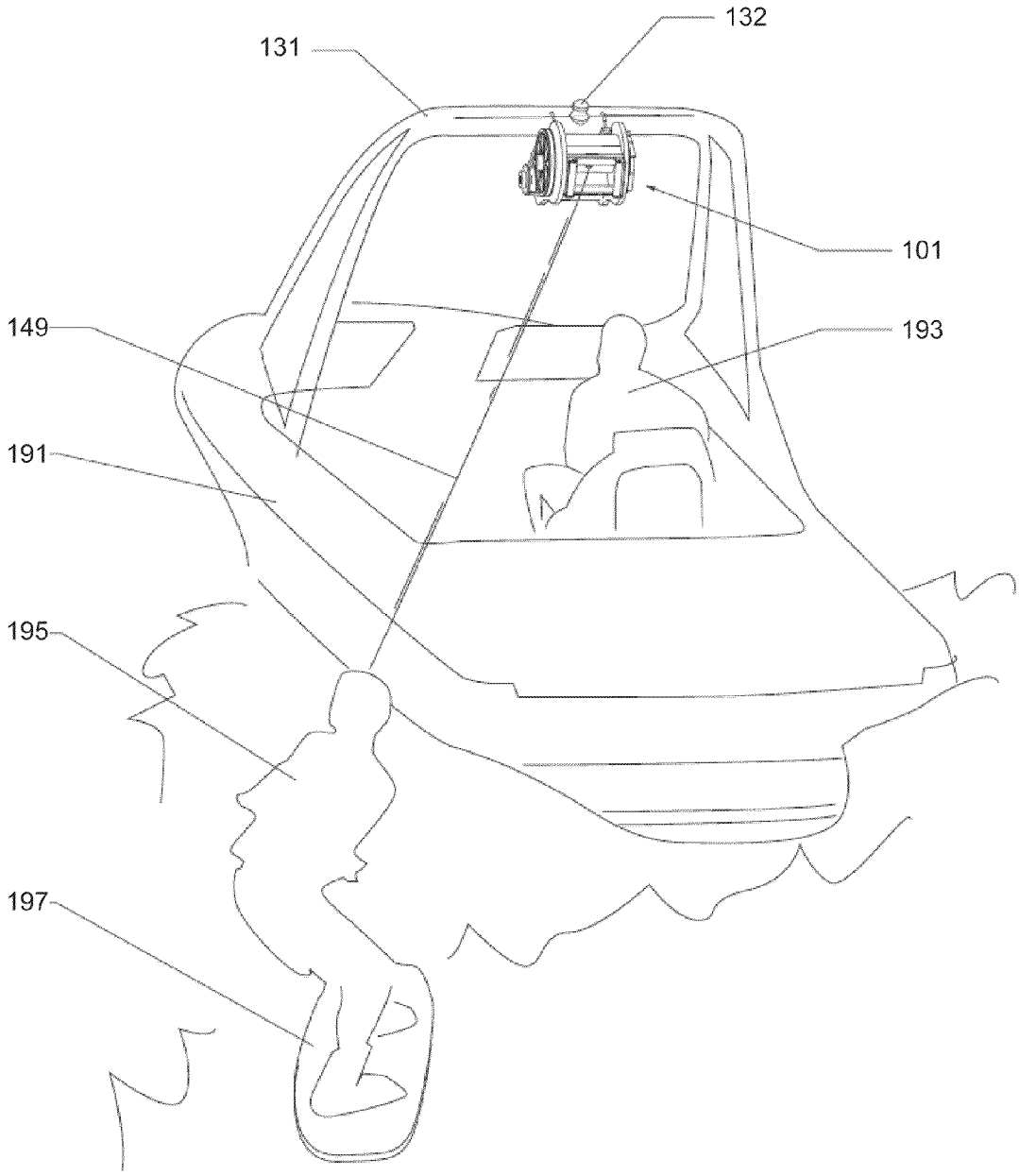
FIG. 2 is an illustrative depiction of a watercraft incorporating a towrope winch according to an embodiment of the present illustrative system and method.

Turning now to FIG. 2, an illustrative depiction of a watercraft (191) incorporating a towrope winch (101), according to principles disclosed herein, is depicted. In FIG. 2, the towrope winch (101) is attached at the top of the tower (131), and receives the towrope (149). Thus, as illustrated in FIG. 2, and described herein, the towrope (149) is not attached directly to the hitch (132) located on the tower (131), but is wound on the towrope winch (101) that is, in turn, attached to the tower (131). The towrope winch (101) can be positioned on the top of the tower (131) to increase the height above the surface of the water at which the towrope (149) is effectively connected to the watercraft (191). This provides additional vertical lift to the user as described above. It is also useful to place the towrope winch (101) at the top of the tower (131) so that the towrope (149) can be readily extended to the rider (195) unobstructed. However, it will be understood by those skilled in the art that the towrope winch (101) described herein need not be mounted on a tower, but may be mounted directly to the deck or other surface of the watercraft (191). Where mounted on the deck or other surface, the winch (101) may extend the rope out to a rider directly or may Utilize a pulley or other device on the tower (131).

In one example, the towrope winch (101) may further include a housing. The housing protects the towrope winch (101) from contaminants such as water and dirt. Further, the housing may be configured to minimized or eliminate the risk of a user being injured by moving parts of the towrope winch (101) or entangling objects like hair or clothing in the towrope winch (101). Still further, the housing may include an aerodynamic design configured to reduce drag created by the presence of the towrope winch (101).

Generally, when the illustrated system is utilized, the rider (195) holds onto the towrope handle (FIG. 4, 198) as both the watercraft (191) and the rider (195) plane over the surface of the water. When the user passes over the wake, the towrope winch (101) may be activated to rapidly retract at least a portion of the towrope (149) and accelerate the rider (195) to provide greater vertical lift while jumping the wake of the watercraft (191).

In one example, a leader cable may be connected to the towrope (149). The leader cable would be wound into the towrope winch (101) and would be made out of a stronger material than the rope itself so as to withstand the wear and tear that would occur as the line is wound into and reeled out by the towrope winch (101). This would extend the life of the towrope (149) by not having the towrope experience such wear and tear. In another example, the towrope (149) may be made of a material that is flexible and lightweight enough to safely function as a towrope, but which is able to withstand the wear and tear that would occur as the towrope (149) is wound into and reeled out by the towrope winch (101). Further, the towrope (149) may be of any length. In one example, the towrope (149) may be between 75 and 100 feet long.

As noted above, in other illustrative embodiments, the towrope winch (101) need not be disposed atop the tower (131). The similar effect can be achieved by belaying the towrope through a pulley or other device on the tower (131). The towrope (149) then runs to the towrope winch (101) located somewhere else on the watercraft (191), perhaps attached to the deck of the watercraft (191).

Figure 3:
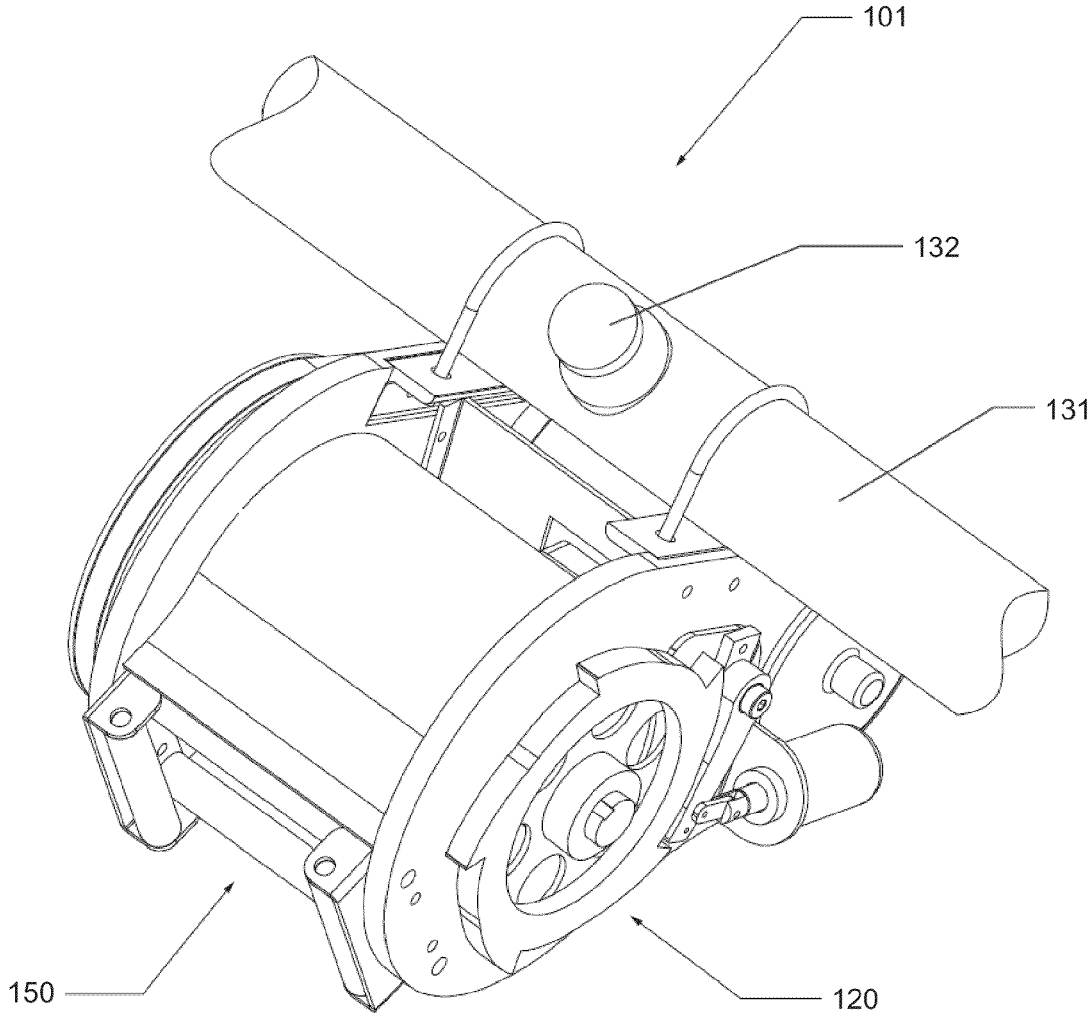
FIG. 3 is a prospective view of the towrope winch according to an embodiment of the present illustrative system and method.
Figure 4:
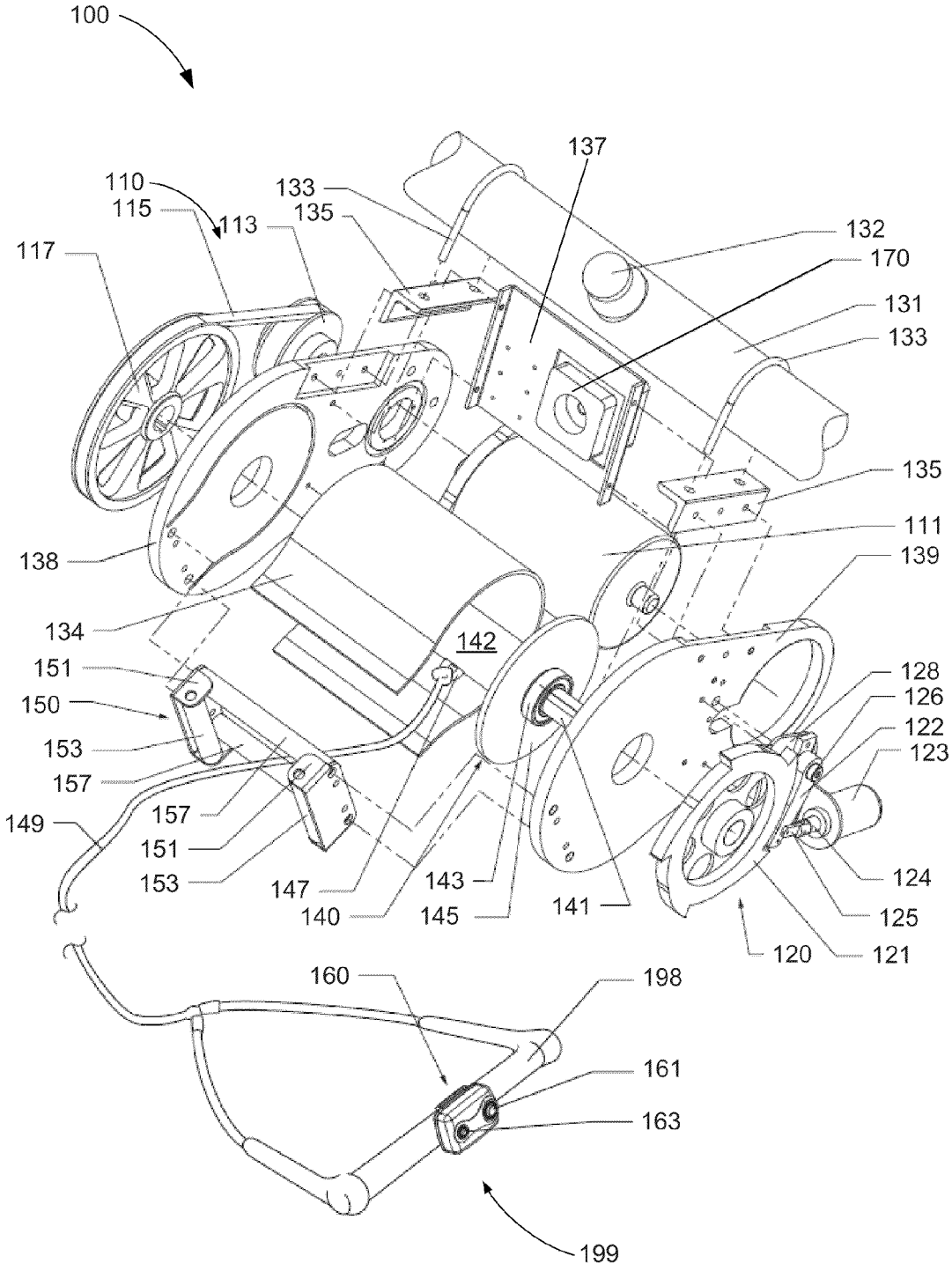
FIG. 4 is a perspective view of a tow system incorporating an exploded view of the towrope winch of FIG. 3, a towrope and towrope handle assembly according to an embodiment of the present illustrative system and method.

FIG. 3 is a perspective view of an towrope winch (101) according to principles disclosed herein. As depicted in FIG. 3, the towrope winch (101) may be coupled to the tower (131). In one possible example, the towrope winch (101) may be mounted on the tower (131) via a number of u-bolts (FIG. 4, 133) and a number of mounting plates (FIG. 4, 135). However, any coupling device or means to couple the towrope winch (101) to the tower (131) may be used.

FIG. 3 depicts a fairlead assembly (150) located at the end of the towrope winch (101) through which the towrope (FIG. 2,149) is fed into the towrope winch (101). The fairlead assembly (150) guides the towrope (FIG. 2,149) into the towrope winch (101), and prevents bunching or snagging of the towrope (FIG. 2,149). Further, the fairlead assembly (150) also prevents chaffing or other forms of wear on the towrope (FIG. 2,149). More specific details with regard to the fairlead assembly (150) will be discussed below.

The towrope winch (101) also includes a brake assembly (120). Various braking systems may be used in the braking assembly (120) including, for example, an air brake system, a disc brake system, a drum brake system, an electromagnetic brake system, or a hydraulic brake system. The brake assembly (120), when engaged, stops the towrope winch (101) from reeling a length of the towrope (FIG. 2,149) in or out. In another example, the brake assembly (120) may also be configured to slow the rate of towrope (FIG. 2,149) feed in and out of the towrope winch (101). More specific details with regard to the brake assembly (120) will also be discussed below.

FIG. 4 is an exploded view of the towrope winch (101) of FIG. 3, along with a towrope (149) and towrope handle assembly (199) according to principles disclosed herein. As depicted in FIG. 4, the tow system (100) may include a towrope handle assembly (199), a towrope (149), a fairlead assembly (150), a reel assembly (140), a brake assembly (120), a brake chassis (139), a motor (111), a motor chassis (138), an electronic control unit (ECU) (170) and a tower (131). Each of these elements will be discussed in more detail below.

As depicted in FIG. 4, the tow system (100) further includes a towrope (149) and towrope handle assembly (199). The towrope handle assembly (199) may further include a towrope handle (198) and a towrope transmitter assembly (160). The towrope handle (198) may be any handle suitable for gripping by a rider (FIG. 2, 195).

Figure 9:
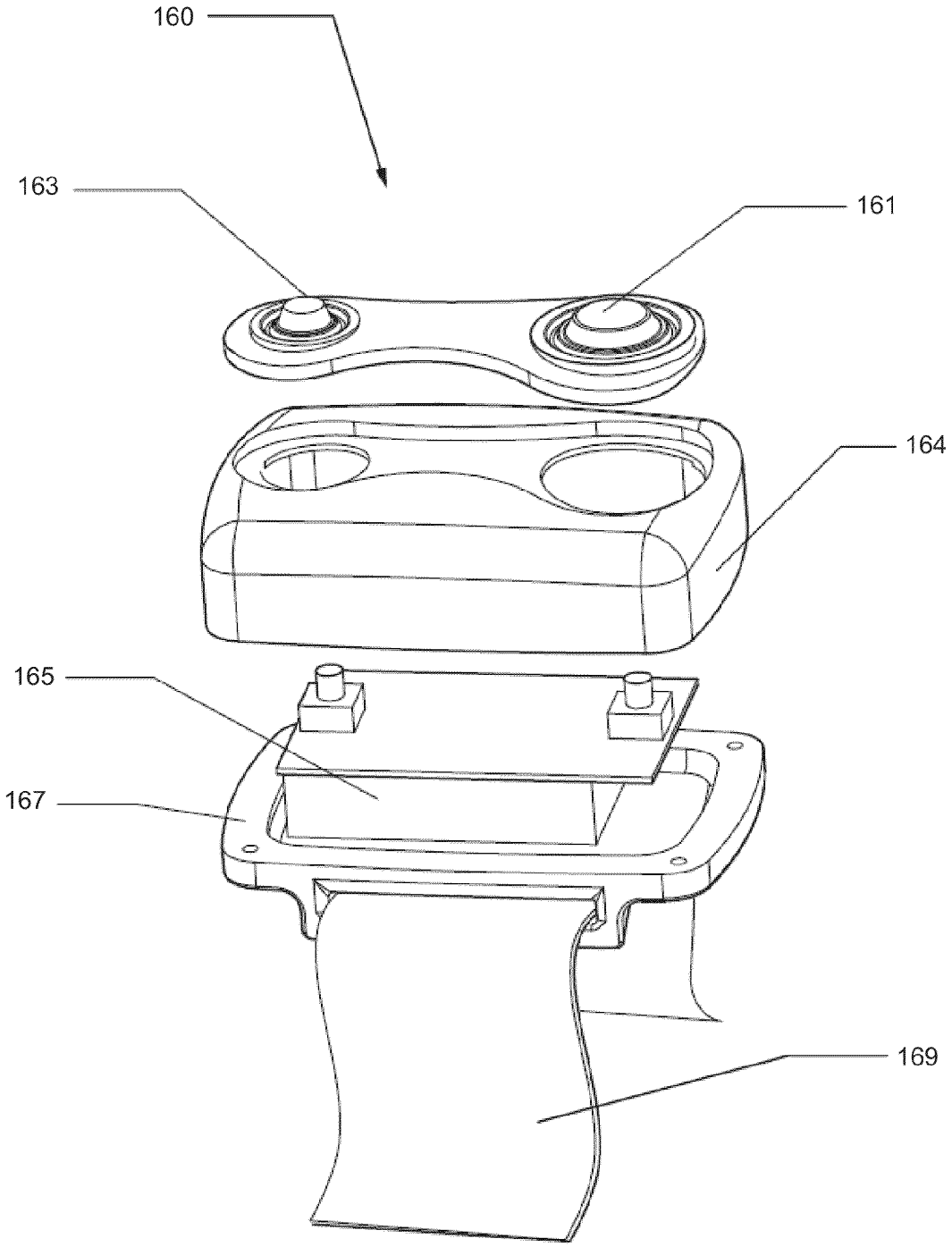
FIG. 9 is an exploded view of a transmitter assembly according to an embodiment of the present illustrative system and method.

The towrope transmitter assembly (160) will now be discussed in more detail in connection with FIGS. 4 and 9. FIG. 9 is an exploded view of the towrope transmitter assembly (160) according to principles disclosed herein. The towrope transmitter assembly (160) may include a fastening strap (169) for coupling the towrope transmitter assembly (160) to the towrope handle (FIG. 4, 198) of the towrope handle assembly (199). Other coupling means may be used to couple the towrope transmitter assembly (160) to the towrope handle (FIG. 4, 198). For example, the towrope transmitter assembly (I 60) may be coupled to the towrope handle (FIG. 4, 198) via gluing, welding, riveting, or via a number of screws or a number of bolts and nuts, or other fasteners.

The towrope transmitter assembly (160) further includes a bottom cover (167), a top cover (164), a reel-in button (161), a reel-out button (163), and transmitter electronics (165). The bottom cover (167) and top cover (164) are configured to form a housing of which the interior thereof is hermetically sealed. In this manner, water and foreign contaminants such as dirt and silt cannot enter the interior space formed by the bottom cover (167) and top cover (164). Thus, the transmitter electronics (165), which are disposed within the space formed by the bottom cover (167) and top cover (164), will be protected from water and foreign contaminants. Further, the bottom cover (167) and top cover (164) also engage with the reel-in button (161) and reel-out button (163) such that water and foreign contaminants cannot enter the space formed by the bottom cover (167) and top cover (164) via the reel-in button (161) and/or reel-out button (163). Finally, since other buttons and other features may be incorporated into the towrope transmitter assembly (160), these other buttons and other features may also engage with the bottom cover (167) and top cover (164) to ensure that water and foreign contaminants cannot enter into the space formed by the bottom cover (167) and top cover (164).

The transmitter electronics (165) are configured to transmit and receive communications to and from the towrope winch (FIG. 3, 101) located on the watercraft (FIG. 2, 191). The rider (FIG. 2, 195) may selectively activate the reel-in button (161) and reel-out button (163). These instructions may be transmitted to the towrope winch (FIG. 3, 101) via wired or wireless communication methods. As examples of wireless forms of communication, instructions from the rider (FIG. 2, 195) may, be transmitted to the towrope winch (FIG. 3, 101) via a radio frequency (RF) transmitter/receiver, a microwave transmitter/receiver, or an infrared (IR) transmitter/receiver. In another illustrative embodiment, the transmitter electronics (165), may be configured to be voice activated, and transmit instructions from the rider (FIG. 2, 195) upon detection of an audible command.

In another illustrative embodiment, the transmitter assembly (160) may be any means configured to transmit data over a wire-based communication technology. For example, a signal wire may be embedded in the towrope (149) for carrying command signals from the transmitter assembly (160) to the towrope winch (FIG. 3, 101). As similarly discussed above with regard to the wireless embodiment, communication between the transmitter assembly (160) and the towrope winch (FIG. 3, 101) is delivered via the embedded signal wire. In this embodiment, the embedded signal wire may be any wire or other direct communication means including metal wires and optical fibers.

The rider (FIG. 2, 195) thus has the ability to control the length of the towrope (149) by activating the reel-in button (161) and reel-out button (163). While being pulled behind the watercraft, the rider (FIG. 2, 195) may selectively push the reel-in button (161), for example, or give a voice command. The transmitter assembly (160) then transmits a command signal to a wireless receiver (FIG. 10, 175) onboard the watercraft. The wireless receiver (FIG. 10, 175) is configured to then relay this information to the ECU (170) which actuates the towrope winch (FIG. 3, 101). The towrope winch (FIG. 3, 101) then releases the brake assembly (120), activates the motor (111), and rapidly reels-in a length of the towrope (149) at a rate that allows the rider (FIG. 2, 195) to utilize the added acceleration and speed of the towrope (149) when riding over the wake of the watercraft (FIG. 2, 191).

As further depicted in FIG. 4, the fairlead assembly (150) may comprise several elements including a fairlead bracket (151), a number of vertical rollers (153), and a number of horizontal rollers (157) interposed between the towrope handle assembly (199) and the remainder of the towrope winch (FIG. 3, 101). The fairlead bracket (151) is configured to house the vertical rollers (153) and horizontal rollers (157). In one illustrative embodiment, two vertical rollers (153) and two horizontal rollers (157) are provided. In this embodiment, the two vertical rollers (153) are positioned on the right and left of the fairlead bracket (151), respectively. Similarly, the two horizontal rollers (157) are positioned at the top and bottom of the fairlead bracket (151), respectively. Further, the fairlead bracket (151) is configured to secure the fairlead assembly (150) to the towrope winch (FIG. 3, 101), and, more specifically, the brake chassis (139) and motor chassis (138). In an alternative embodiment, smoothed edges formed on the interior of the fairlead bracket (151) may be used instead of the vertical rollers (153) and horizontal rollers (157).

Figure 5:
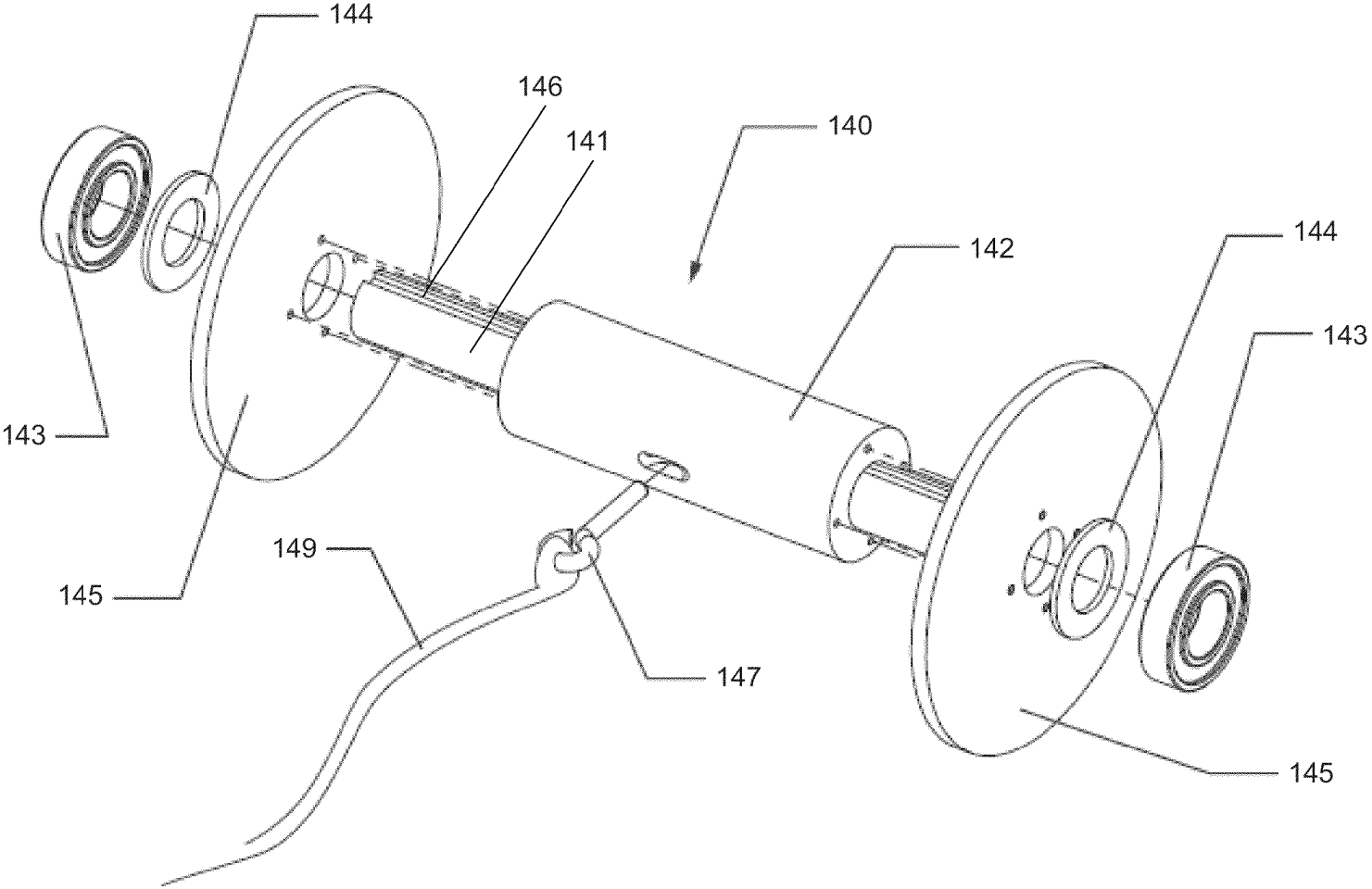
FIG. 5 is an exploded view of the reel assembly of the towrope winch of FIG. 4 according to an embodiment of the present illustrative system and method.

FIG. 4 also depicts a reel assembly (140). The reel assembly (140) will now be described in more detail in connection with both FIG. 4 and FIG. 5. FIG. 5 is an exploded view of the reel assembly of the towrope winch of FIG. 4 according to principles disclosed herein. The reel assembly (140) may include a reel drive shaft (141), a number of reel bearings (143), a number of reel spacers (FIG. 5, 144), a number of reel flanges (145), a reel drum (142) a towrope eye (147), and a reel guard (134). As depicted in FIG. 4, two of each of the reel bearings (143), reel spacers (FIG. 5, 144), and reel flanges (145) are positioned at respective ends of the reel assembly (140). However, more or less of these elements (143, 144, 145) may be included in the reel assembly (140). The various elements of the reel assembly (140) will now be individually described in more detail.

As depicted in FIGS. 4 and 5, the reel drive shaft (141) is a shaft or rod around which the reel bearings (143), reel spacers (144), reel flanges (145), and reel drum (142) are coupled. The reel drive shaft (141) may be composed of a rigid material such as a metal. A drive shaft recess (146) may be defined along at least a portion of the longitudinal axis of the reel drive shaft (141). Thus, the reel bearings (143), reel spacers (144), reel flanges (145), and reel drum (142) are coupled to the reel drive shaft (141) by mating with the drive shaft recess (146).

In one illustrative embodiment, the reel bearings (143), reel spacers (144), reel flanges (145), and reel drum (142) are coupled to the reel drive shaft (141) by a number of set screws. In this embodiment, set screw bores are defined in each of the reel bearings (143), reel spacers (144), reel flanges (145), and reel drum (142), and the set screws engaged in each set screw bore of each element (143, 144, 145, 142). In this manner, the set screws engage with the set screw bores and the drive shaft recess (146) defined in the reel drive shaft (141). Thus, the reel bearings (143), reel spacers (144), reel flanges (145), and reel drum (142) do not move relative to the reel drive shaft (141).

In yet another illustrative embodiment, a groove similar to the drive shaft recess (146) of the reel drive shaft (141) may be defined in each of the reel bearings (143), reel spacers (144), reel flanges (145), and reel drum (142). In this embodiment, a key pin (FIG. 8, 130) may be disposed within the void formed by the grooves formed in the various elements (143, 144, 145, 142) and the drive shaft recess (146). However, the present system may employ any means that secures the reel bearings (143), reel spacers (144), reel flanges (145), and/or reel drum (142) to the reel drive shaft (141) in order to prevent these elements from moving relative to the drive shaft (141).

FIGS. 4 and 5 also depict reel bearings (143). The reel bearings (143) are configured to provide support for the reel drive shaft (141). In one illustrative embodiment, two sets of reel bearings (143) may be provided that are configured to engage with the motor chassis (FIG. 4, 138) and brake chassis (FIG. 4, 139) on respective ends of the reel drive shaft (141). In this manner, the reel drive shaft (141) is free to rotate within the reel bearings (143) while being guided and supported within the motor chassis (FIG. 4, 138) and brake chassis (FIG. 4, 139).

Further, as depicted in FIGS. 4 and 5, a number of reel spacers (144) may be position around the reel drive shaft (141), and between the reel bearings (143) and reel flanges (145). In one illustrative embodiment, two reel spacers (144) may be provided; one on each end of the reel assembly (140). The reel spacers (144) provide for an amount of space between the reel flange (145) and motor chassis (FIG. 4, 138) and brake chassis (FIG. 4, 139) such that the reel flanges (145) do not rub or wear against either the motor chassis (FIG. 4, 138) or brake chassis (FIG. 4, 139).

FIGS. 4 and 5 also depict a number of reel flanges (145). In one embodiment, two reel flanges (145) may be provided around the reel drive shaft (141), and between the reel spacers (144) and the reel drum (142) at respective ends of the reel assembly (140). The reel flanges (145) may be made of any resilient material such as metal, and are configured to retain the towrope (149) on the reel drum (142) so that no portion of the towrope (149) is allowed to wrap around any other portion of the reel assembly (140) except the reel drum (142). For example, the reel flanges (145) are configured to prevent any portion of the towrope (149) from wrapping around the reel spacers (144) and/or reel bearings (143).

Still further, FIGS. 4 and 5 depict the reel drum (142). The reel drum may be made of any material including metal. The reel drum (142) may be of a general cylindrical shape so that the towrope (149) can evenly wind around the reel drum (142). The reel drum (142) may also include a towrope eye (147). The towrope eye (147) may be permanently or removably coupled to the reel drum (142). As depicted in FIGS. 4 and 5, the towrope (149) may be coupled to the towrope eye (147). This may be accomplished by any method including, but not exhaustive of, tying the end of the towrope (149) to the towrope eye (147), or fusing the end of the towrope (149) after it has been threaded through the towrope eye (147). Once the towrope (149) has been attached to the reel drum (142) via the towrope eye (147), the towrope (149) may be wound onto the reel drum (142) by activating the reel assembly (140). In one illustrative embodiment, a line guide (not shown) may also be provided to ensure that any length of the towrope (149) does not bunch on one portion of the reel drum (142).

Finally, as depicted in FIG. 4, the reel assembly (140) may include a reel guard (134). The reel guard (134) may be made of any resilient material such as a metal, and functions to assist the fairlead assembly (150) in guiding the towrope (149) onto the reel drum (142) as the reel assembly (140) begins to reel-in the towrope (149). The reel guard (134) is positioned behind the fairlead assembly (150) and extends around the reel assembly (140). Therefore, the reel guard (134) provides a barrier between moving parts such as the reel assembly (140) and other objects. In this manner, the reel guard (134) helps to reduce or eliminate the risk of a user being injured by moving parts or entangling objects like hair or clothing in the towrope winch (101). As depicted in FIG. 4, the motor chassis (138) and brake chassis (139) may include a recess configured to engage with the reel guard (134) such that the reel guard (134) is maintained in position relative to the motor chassis (138) and brake chassis (139) as well as the reel assembly (140) and fairlead assembly (150).

Figure 6:
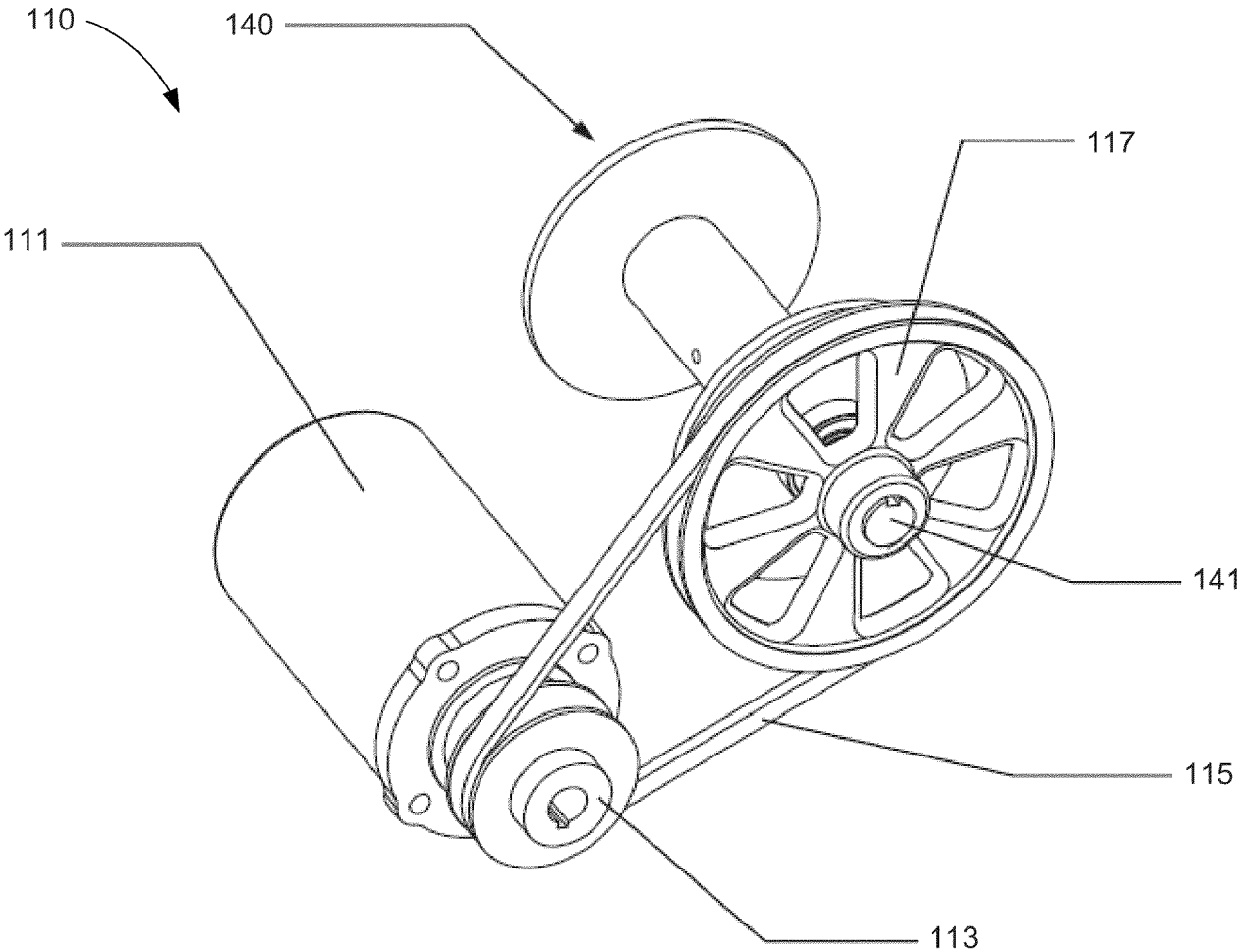
FIG. 6 is a perspective view of a power train including a motor coupled to the reel assembly of the tow system of FIG. 4 according to an embodiment of the present illustrative system and method.

The tow system (100) further includes a power train (110) as depicted in FIGS. 4 and 6. FIG. 6 is a perspective view of the power train (110) including the motor (111) coupled to the reel assembly (140) of the tow system (100) of FIG. 4 according to an embodiment of the present illustrative system and method. Specifically, the power train (110) includes the motor (111), a motor pulley (113), a belt (115), and a reel pulley (117).

The motor (111) may be any device that receives and modifies energy from some source and utilizes it in driving machinery. For example, the motor (111) may be an electric motor, a pneumatic motor, a hydraulic motor, or an internal combustion engine. In one illustrative embodiment, the motor (111) may be an electric motor configured to draw electrical energy from the engine and/or battery of the watercraft (FIG. 2, 191) and/or from an auxiliary power source such as a second battery. In one illustrative embodiment, the motor (111) may be coupled to a heat sink as will be discussed in more detail below.

In one illustrative embodiment, the radial velocity of the motor (111) is variable. Providing variable radial velocity makes it possible to output different towrope (149) reel-in and reel-out speeds and rates of acceleration. With different towrope (149) reel-in and reel-out speeds and rates of acceleration, individual riders (FIG. 2, 195) can use the tow system (100) at a number of specific speeds that are comfortable and provide the desired acceleration. For example, more experienced riders may want a faster towrope (149) reel-in and reel-out speed and rate of acceleration than less experienced beginner or intermediate riders.

In another illustrative embodiment, the motor (111) may be configured to pulse or otherwise slow the towrope (149) as it is reeled in, reeled out, or both. For example, as the towrope (149) is being reeled out, the motor (111) may pulse to slow the reeling out of the towrope (149). Similarly, the motor may be configured to pulse in order to slow the reeling in of the towrope (149). In this manner, the motor (111) acts as a brake apart from the brake assembly (120), and braking of the reel assembly (140) in both rotational directions. Thus, in some examples, braking may be controlled entirely by the motor (111).

More generally, the motor (111) is configured to drive the reel assembly (140) in a reel-in direction, a reel-out direction, or both. The motor (111) may be operatively connected to the reel assembly (140) via a belt and pulley system comprising the motor pulley (113), the belt (115), and the reel pulley (117). The motor pulley (113) is coupled to a drive shaft of the motor (111) such that it does not move relative to the drive shaft of the motor (111). Similarly, the reel pulley (117) is coupled to the reel assembly (140) such that it does not move relative to the reel drive shaft (141) of the reel assembly (140). This may be accomplished in the same manner as discussed above in connection with the various elements of the reel assembly (140).

Specifically, in one illustrative embodiment, the motor pulley (113) and reel pulley (117) may be coupled to the motor (111) and reel drive shaft (141), respectively, by a number of set screws. In this embodiment, set screw bores are defined in each of the motor pulley (113) and reel pulley (117). In this manner, the set screws engage with the set screw bores and a drive shaft recess defined in the drive shaft of the motor, and the drive shaft recess (146) defined in the reel drive shaft (141). Thus, the motor pulley (113) and reel pulley (117) do not move relative to the drive shaft of the motor and the reel drive shaft (141), respectively.

In yet another illustrative embodiment, a groove similar to the drive shaft recess (146) of the reel drive shaft (141) may be defined in each of the motor pulley (113) and reel pulley (117). In this embodiment, a motor drive shaft key pin and the key pin (FIG. 8, 130) may be disposed within the void formed by the grooves formed in the motor pulley (113) and reel pulley (117), and in the drive shaft recess defined in the drive shaft of the motor and the drive shaft recess (146), respectively. However, the present system may employ any means that secures the motor pulley (113) and/or reel pulley (117) to the drive shaft of the motor and reel drive shaft (141) in order to prevent these elements from moving relative thereto. Therefore, as depicted in FIGS. 4 and 6, the motor (111) provides rotational force to the motor pulley (113), which, in turn, rotates the reel pulley (117) and reel assembly (140) via the belt (115). In another illustrative embodiment, the power train may include a number of cogs and a chain. In this embodiment, a cog is provided instead of the motor pulley (113) and another cog is provided instead of the reel pulley (117). The chain may then be placed around the cogs such that the chain engages with the cogs. In this manner, the cogs and chain provide the means by which the rotational force provided by the motor (111) is translated to the reel assembly (140).

Still further, in another illustrative embodiment, the motor (111) may be coupled to a series of gears (not shown). Different gear ratios that will change the radial velocity and torque of the motor's (111) output into a specific radial velocity and torque that can be utilized in different circumstances. In one example, the gears may provide a gear ratio that produces a radial velocity of 500 to 1000 or more revolutions per minute (RPM's). This radial velocity makes it possible for the rider (195) to experience an increase in acceleration through the tow system (100). In one illustrative embodiment, the gears may be adjustable such that a rider (195) can vary the speed and acceleration at which the towrope (149) is wound by the towrope winch (101).

The towrope winch (FIG. 3, 101) may also include a heat sink (137). The heat sink (137) is placed juxtaposition to the motor (111) and/or ECU (170). In one illustrative embodiment discussed above, a heat sink is placed between the reel assembly (140) and the motor (111). In another illustrative embodiment, the heat sink (137) may be positioned next to or coupled to the ECU (170). The heat sink (137) is configured to absorb and dissipate heat away from the ECU (170) and/or motor (111) such that the ECU (170) and motor (111) are not subjected to temperatures that may damage the ECU (170) or motor (111) or cause the ECU (170) or motor (111) to prematurely wear or not perform as intended.

Figure 7:
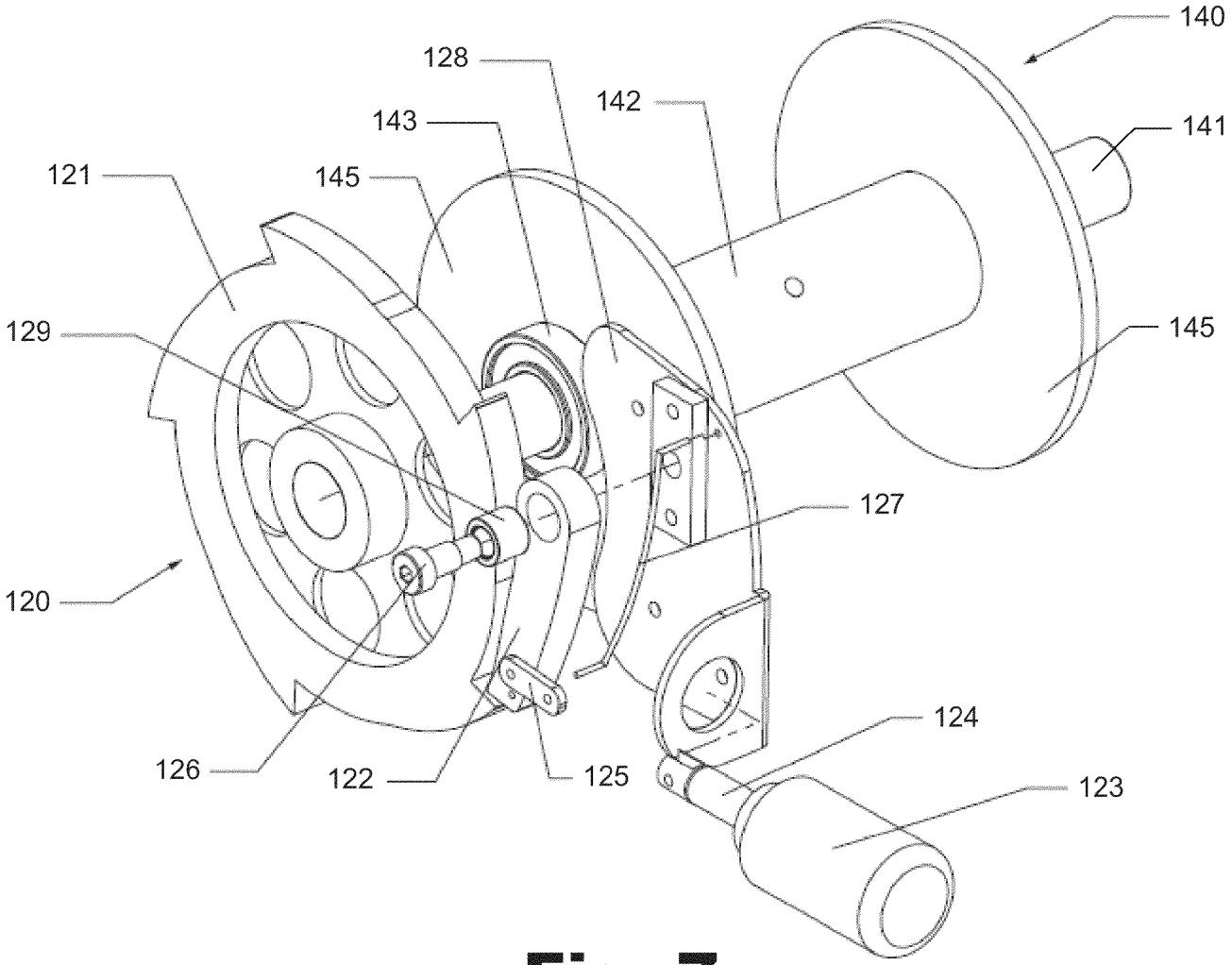
FIG. 7 is a perspective view of a brake assembly coupled to the reel assembly of the tow system of FIG. 4 according to an embodiment of the present illustrative system and method.
Figure 8:
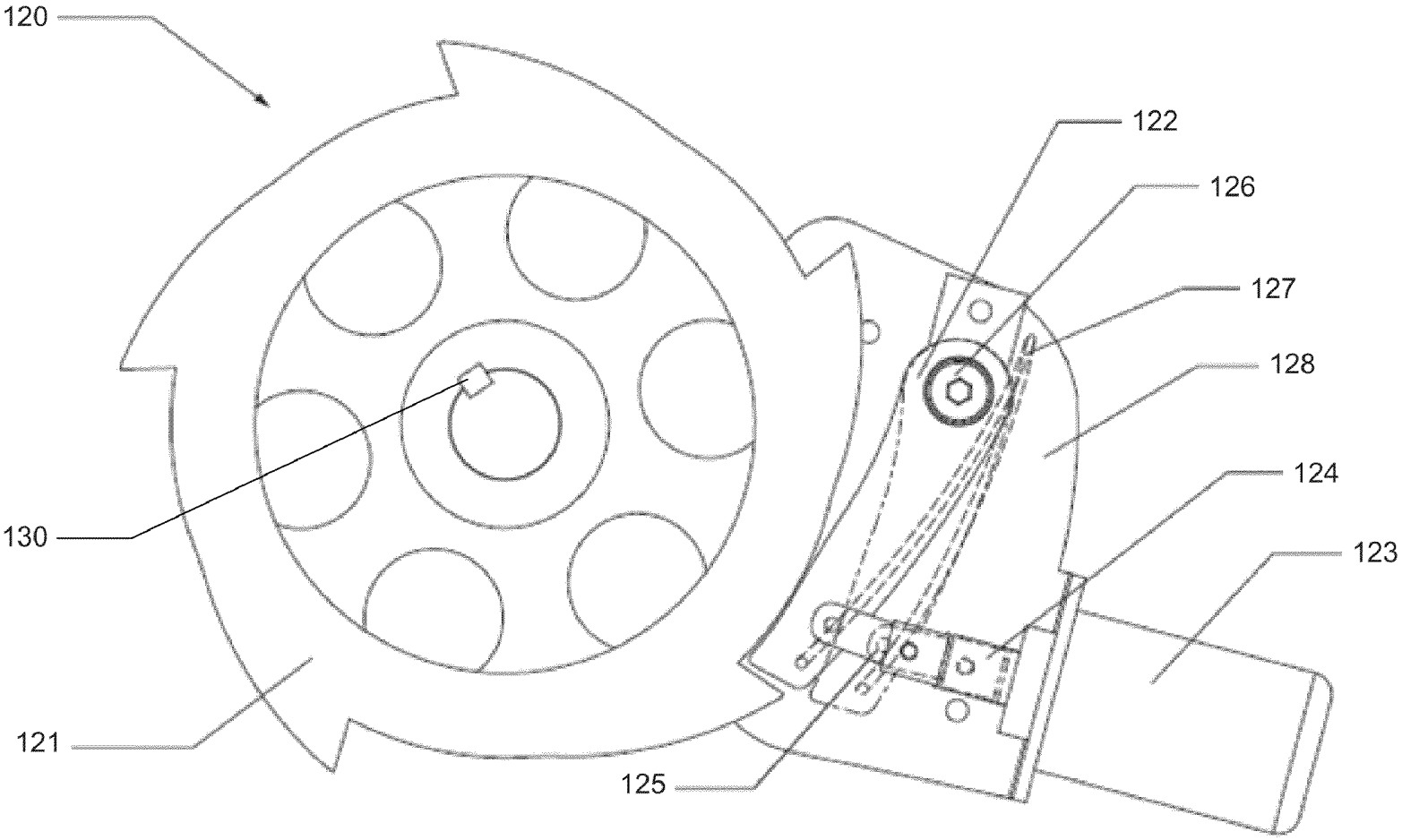
FIG. 8 is a side view of the brake assembly of FIGS. 4 and 7 showing the actuation of the brake assembly according to an embodiment of the present illustrative system and method.

The brake assembly (120) will now be described in more detail in connection with FIGS. 4, 7, and 8. FIG. 7 is an exploded view of the brake assembly (120) coupled to the reel assembly (140) of the tow system (100) of FIG. 4 according to an embodiment of the present illustrative system and method. FIG. 8 side view of the brake assembly of FIGS. 4 and 7 showing the actuation of the brake assembly (120) according to an embodiment of the present illustrative system and method. Generally, the brake assembly (120) may include a ratchet wheel (121), a pawl (122), a pawl pivot bolt (126), a pawl bearing (129), a pawl spring (127), a pawl support plate (128), a pawl linkage (125), a solenoid body (123), and a solenoid plunger (124). This embodiment provides for a more quite braking system that is also less expensive than other braking systems.

In general, the brake assembly (120) may include any ratcheting device that allows continuous rotary motion of the ratchet wheel (121) in only one direction while selectively preventing motion in the opposite direction. The ratchet wheel (121) may have any number of teeth configured to engage with the pawl (122). In one illustrative embodiment, the ratchet wheel (121) may have between 5 and 10 teeth. In FIGS. 4, 7, and 8, the ratchet wheel (121) is free to move in the clockwise direction as viewed from the perspective of FIG. 8, but prevented from rotating in the counter clockwise direction by the engagement of the pawl (122). Further, when the pawl (122) is not engaged, the ratchet wheel (121) is free to move in either the clockwise or counter clockwise directions.

The ratchet wheel (121) is mounted on the reel assembly (140), and, in particular, the reel drive shaft (141). The reel bearing (143) engages with the brake chassis (139) as discussed above, and the ratchet wheel (121) is coupled to the reel drive shaft (141) through the brake chassis (139). Thus, the brake chassis (139) is positioned between the reel assembly (140) and ratchet wheel (121). As similarly discussed above, the ratchet wheel (121) may be coupled to the reel drive shaft (141) by a number of set screws. In this embodiment, a number of set screws bores are defined in the ratchet wheel (121), and the set screws engaged in each set screw bore of the ratchet wheel (121). In this manner, the set screws engage with the set screw bores and the drive shaft recess (FIG. 5, 146) defined in the reel drive shaft (141). Thus, the ratchet wheel (121) does not move relative to the reel drive shaft (141).

In yet another illustrative embodiment, a groove similar to the drive shaft recess (FIG. 5, 146) of the reel drive shaft (141) may be defined in the ratchet wheel (121). In this embodiment, a key pin (FIG. 8, 130) may be disposed within the void formed by the groove formed in the ratchet wheel (121) and the drive shaft recess (FIG. 5, 146). However, the present system may employ any means that secures the ratchet wheel (121) to the reel drive shaft (141) in order to prevent the ratchet wheel (121) from moving relative to the drive shaft (141).

The pawl (122) is coupled to the brake chassis (139) via a pawl support plate (128). The pawl support plate (128) is coupled to the brake chassis (139) via gluing, welding, riveting, or via a number of screws or a number of bolts and nuts, or other fasteners. However, the pawl support plate (128) may be coupled to the brake chassis (139) by any means that sufficiently secures the pawl support plate (128) to the brake chassis (139).

As depicted in FIGS. 4, 7, and 8, the pawl (122) has a pivoting end about which it pivots, and also includes a distal end that is configured to engage with the ratchet wheel (121). The pawl (122) is coupled to the pawl support plate (128) via the pawl pivot bolt (126) and pawl bearing (129). The pawl pivot bolt (126) may be any bolt that is configured to secure the pawl (122) to the pawl support plate (128). In one illustrative embodiment, and as depicted in FIGS. 4, 7, and 8, pawl pivot bolt (126) is configured to be countersunk within the pawl (122). A pawl bearing (129) may also be provided. The pawl bearing (129) is position around the pawl pivot bolt (126), and countersunk within the pawl (122) with the pawl pivot bolt (126). In this manner, the pawl bearing (129) allows unrestrictive movement of the pawl (122) about the pawl pivot bolt (126).

As depicted in FIGS. 4, 7, and 8, the brake assembly (120) may also include a pawl spring (127). In one illustrative embodiment, the pawl spring (127) is biased to pull the pawl (122) to the left, as depicted in FIG. 8, and engage the pawl (122) in the teeth of the ratchet wheel (121). Thus, in this embodiment, the pawl spring (127) is configured to automatically engage the brake assembly (120) when no force is applied to the pawl (122) in the right or non-engagement direction. In another embodiment, the pawl spring (127) may be biased to the pull the pawl (122) to the right, and remain disengaged with the ratchet wheel (121) until a force is applied in the left or engagement direction.

The pawl spring (127) is coupled to the pawl (122) in a manner such that the pawl spring (127) cannot slip around or move relative to the pawl (122). In one illustrative embodiment, and as depicted in FIGS. 7 and 8, an end of the pawl spring (127) may be configured to enter a hole defined in the distal end of the pawl (122). Thus, the pawl spring (127) is always engaged with the pawl (122). However, the pawl spring (127) may be coupled to the pawl (122) in any manner including, for example, gluing, welding, riveting, or via a number of screws or a number of bolts and nuts, or other fasteners.

The brake assembly (120) further comprises a pawl linkage (125), a solenoid body (123), and a solenoid plunger (124). The solenoid plunger (124) is coupled to the distal end of the pawl (122) via the pawl linkage (125) as depicted in FIGS. 4, 7, and 8. The solenoid body (123) is configured to be selectively activated. When this occurs, the solenoid body (123) moves the solenoid plunger (124) such that the solenoid plunger (124) causes the pawl (122) to disengage with the ratchet wheel (121) via the pawl linkage (125). In other words, the solenoid body (123), upon activation, pulls the solenoid plunger (124) to the right as depicted in FIG. 8, such that the pawl (122) disengages the ratchet wheel (121). Similarly, the solenoid body (123) is further configured to be selectively deactivated, causing the solenoid plunger (124) to move to the left due to the spring force of the pawl spring (127) such that the pawl (122) engages with the ratchet wheel (121). The solenoid body (123) is coupled to the pawl support plate (128) by, for example, gluing, welding, riveting, or via a number of screws or a number of bolts and nuts, or other fasteners.

In addition to the elements described above, the tow system (100) of FIG. 4 may also incorporate a number of fans and ducts throughout the tow system (100) for cooling various devices within the tow system (100). More specifically, the fans and ducts may be configured to run throughout the tow system (100) in a manner so as to cool elements of the tow system (100) that heat up during operation of the tow system (100) such as the ECU (170) and the power train (110).

Figure 10:
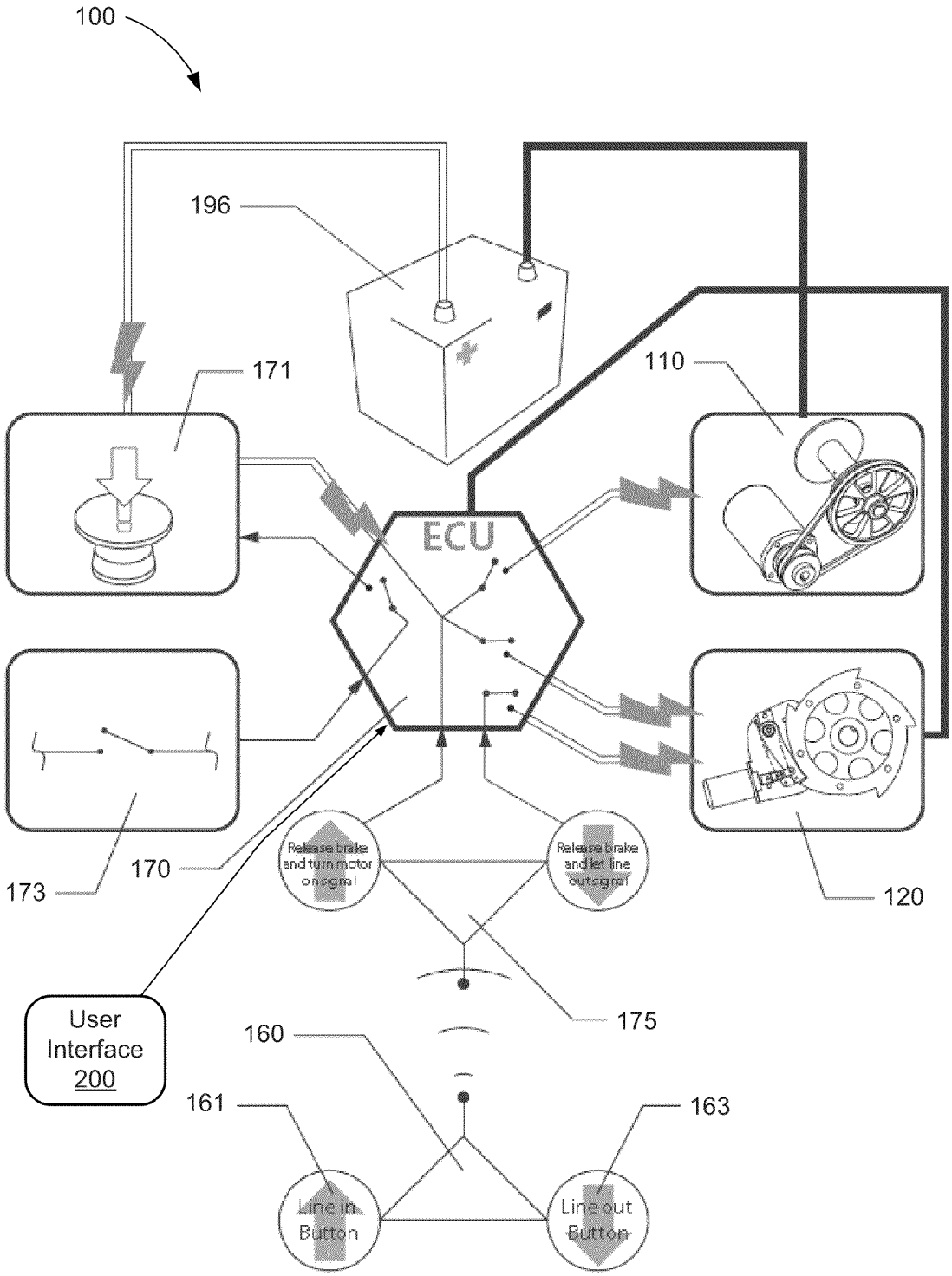
FIG. 10 is a block diagram of the various systems of the tow system of FIG. 4 according to an embodiment of the present illustrative system and method.

FIG. 10 is a block diagram of the various systems of the tow system (100) of FIG. 4 according to an embodiment of the present illustrative system and method. The tow system (FIG. 4, 100) may include an electronic control unit (ECU) (170), a power source (196), the power train (110), the brake assembly (120), an emergency shut-off switch (171), a number of safety switches (173), the wireless receiver (175), and the towrope transmitter assembly (160).

As depicted in FIG. 10, the ECU (170) may be any device that controls one or more of the electrical systems or subsystems of the tow system (FIG. 4, 100), and may include a processor, central processing unit, or other controller. The ECU (170) may be embodied in the tow system (FIG. 4, 100), the watercraft (FIG. 2, 191), or may be located away from both the tow system (FIG. 4, 100) and the watercraft (FIG. 2, 191). In one illustrative embodiment, the ECU (170) is contained within the tow system (FIG. 4, 100), and may be electronically coupled to one or more systems within the watercraft (FIG. 2, 191), or other ECU devices of the watercraft (FIG. 2, 191). In this embodiment, the ECU (170) may, for example, be configured to receive instructions from a user via the transmitter assembly (160) or user interface system (FIGS. 11 and 12, 200), and control the watercraft (FIG. 2, 191). For example, the ECU (170), after receiving instructions, may be configured to cause the watercraft (FIG. 2, 191) to increase its speed. Further, the ECU (170) may also be configured to cause the watercraft (FIG. 2, 191) to accelerate at a predefined or user defined rate. In this manner, the rider (FIG. 2, 195) may have more control over the functions of the watercraft (FIG. 2, 191). In another illustrative embodiment, the ECU (170) may be contained within the watercraft (FIG. 2, 191) as either a pre-market or an after-market component.

Further, the ECU (170) may receive instructions from a user of the tow system (FIG. 4, 100). For example, the ECU (170) may receive instructions from a rider (FIG. 2, 195) via the transmitter assembly (160). In addition, the ECU (170) may receive instructions from a user interface system (FIGS. 11 and 12, 200) located within the watercraft (FIG. 2, 191) or at a remote location such as a shore area. The user interface system (FIGS. 11 and 12, 200) will be discussed in more detail below.

As depicted in FIG. 10, the ECU (170) is configured to control the power train (110), and, more specifically, the motor (111). The ECU (170) controls the direction at which the motor (111) turns, and, thus, effects the rotational direction of the reel assembly (FIGS. 4 and 5, 140) (coupled to the motor (111) via the motor pulley (113), belt (115), and reel pulley (117)). For example, the ECU (170), upon receiving instructions to reel in the towrope (FIGS. 4 and 5, 149), controls the motor (111) to turn in the direction required for reeling in the towrope (FIGS. 4 and 5, 149). Similarly, the ECU (170), upon receiving instructions to reel out the towrope (FIGS. 4 and 5, 149), controls the motor (111) to turn in the direction required for reeling out the towrope (FIGS. 4 and 5, 149). For example, upon receiving instructions to reel out the towrope (FIGS. 4 and 5, 149), the ECU (170) causes the brake assembly (120) to disengage the pawl (FIGS. 4, 7 and 8, 122) from the ratchet wheel (FIGS. 4, 7 and 8, 121), and causes the motor to reel out the towrope (FIGS. 4 and 5, 149).

In one illustrative embodiment, the ECU (170) may be configured to cause the motor (FIGS. 4 and 6, 111) to pulse during the reeling out of the towrope (FIGS. 4 and 5, 149). In this embodiment, the motor (FIGS. 4 and 6, 111) slows or otherwise modifies the speed and/or acceleration of the reel out of the towrope (FIGS. 4 and 5, 149). Thus, a rider (FIG. 2, 195) can experience a slower reel out of the towrope (FIGS. 4 and 5, 149) if the rider (FIG. 2, 195) is, for example, less experienced.

The ECU (170) may also be configured to control the brake assembly (120), and, more specifically, the solenoid body (FIGS. 4, 7, and 8, 123). The ECU (170) controls the activation and deactivation of the solenoid body (FIGS. 4, 7, and 8, 123). As described above, this in turn engages the pawl (FIGS. 4, 7 and 8, 122) with the ratchet wheel (FIGS. 4, 7, and 8, 121). Thus, upon receiving instructions to stop the reeling in or reeling out of the towrope (FIGS. 4 and 5, 149), the ECU (170) is configured to actuate the brake assembly (120).

Further, the ECU (170) may be configured to deactivate one or more devices or assemblies of the tow system (100) or watercraft (FIG. 2, 191) upon activation of an emergency shut-off switch (171). Any number of emergency shut-off switches (171) may be located on the tow system (100), the user interface (160), the winch housing, or elsewhere in the watercraft (FIG. 2, 191). For example, an emergency shut-off switch (171) may be located with the transmitter assembly (160), on the towrope winch (FIG. 3, 101), or on the watercraft (FIG. 2, 191). Upon activation of one or more of the emergency shut-off switches (171), the ECU (170) may deactivate, for example, the motor (FIGS. 4 and 6, 111), and may ensure engagement of the brake assembly (120). In one illustrative embodiment, the tow system (100) will not re-activate until one or more of the emergency shut-off switches (171) are deactivated. In this manner, the emergency shut-off switches (171) provide a safe environment for the rider (FIG. 2, 195) where, in the event of an unforeseen incident, the rider (FIG. 2, 195), operator (FIG. 2, 193), or other person may activate one or more of the emergency shut-off switches (171).

Finally, the ECU (170) may be configured to deactivate one or more devices or assemblies of the tow system (100) or watercraft (FIG. 2, 191) upon activation of a number of safety switches (173) in a similar manner as detailed above in connection with the emergency shut-off switches (171). In one illustrative embodiment, the safety switches (173) may include, for example, switches which are activated in the event that an object like hair, loose clothing or other foreign objects are pulled into the towrope winch (FIG. 3, 101). In another illustrative embodiment, the safety switches (173) may include, for example, switches that are activated in the event that the rider (FIG. 2, 195) no longer is holding onto the towrope (FIGS. 4 and 5, 149). In this embodiment, if the angle of the towrope (FIGS. 4 and 5, 149) and/or tension applied to the towrope (FIGS. 4 and 5, 149) changes from the angle and tension that would be expected while the rider is holding onto the towrope (FIGS. 4 and 5, 149), a safety switch (173) may be activated. In yet another illustrative embodiment, the safety switches (173) may include, for example, switches which are activated in the event that the towrope winch (FIG. 3, 101) is improperly coupled to the tower (FIGS. 2, 3, and 4, 131) of the watercraft (FIG. 2, 191).

In yet another illustrative embodiment, the safety switches (173) may include, for example, switches that are activated if the rider (FIG. 2, 195) reels in too much of the length of the towrope (FIGS. 4 and 5, 149) so as to place the rider (FIG. 2, 195) too close to the back end of the watercraft (FIG. 2, 191) such as the swim deck, or from moving parts of the watercraft (FIG. 2, 191) such as those associated with an inboard, outboard, or inboard/outboard motor.

Thus, if a certain length of towrope (FIGS. 4 and 5, 149) is reeled in, the safety switch (173) of this embodiment may be activated. The length of towrope (FIGS. 4 and 5, 149) that may be reeled in before this safety switch (173) is activated may be predefined, user-defined, or based on a fraction the entire length of the towrope (FIGS. 4 and 5, 149). Further, activation of this safety switch (173) may cause the ECU (170) to deactivate the motor (FIGS. 4 and 6, 111), engage the brake assembly (120), or both. Finally, in one illustrative embodiment, one or more of the above-explained safety switches (173) may be deactivated or otherwise rendered inoperable by a user.

Finally, the ECU (170) may be configured to control or interact with a user interface system (200). The user interface system (200) may be any device, system of devices, computer code, or combinations thereof that may be utilized by a user in controlling the input and output of a computing system or other device. The user interface system (200) will now be described in more detail.

Figure 11:
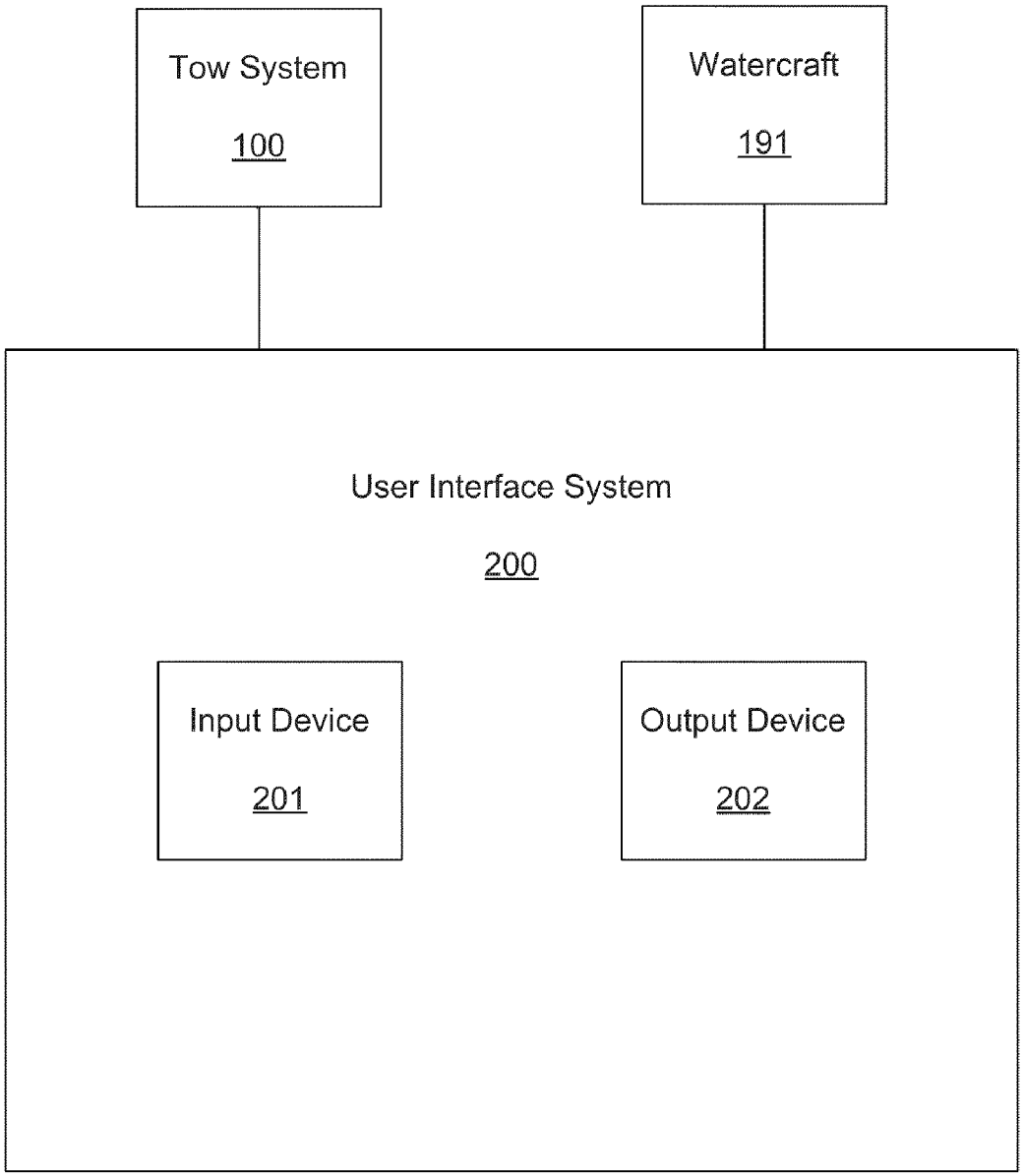
FIG. 11 is a block diagram of the tow system of FIG. 4 incorporating a user interface system according to an embodiment of the present illustrative system and method.

FIG. 11 is a block diagram of the tow system (100) of FIG. 4 incorporating a user interface system (200) according to an embodiment of the present illustrative system and method. The user interface system (200) may include a number of input devices (201) such as, for example, a keyboard, a mouse, and/or a touch screen display for imputing information to an information processing system. Further, the user interface system (200) may also include a number of output devices (202) such as, for example, a display device and/or touch screen display in order to communicate the results of data processing carried out by an information processing system to a user.

In the illustrative embodiment of FIG. 11, the information processing system may include or be embodied in the tow system (100) and/or the watercraft (FIG. 2, 191). In this illustrative embodiment, the ECU (FIG. 10, 170) of the tow system (100) is configured to receive instructions from the user via the user interface system (200), and perform such instructions. Further, in this embodiment, the watercraft may be configured to also receive instructions from a user via the user interface system (200), and perform such instructions. As depicted in FIG. 11, these instructions are relayed to the tow system (100) and watercraft (191) via the input devices (201), and information regarding the operation of the tow system (100) and watercraft (191) are displayed on one or more of the output devices (202).

Figure 12:
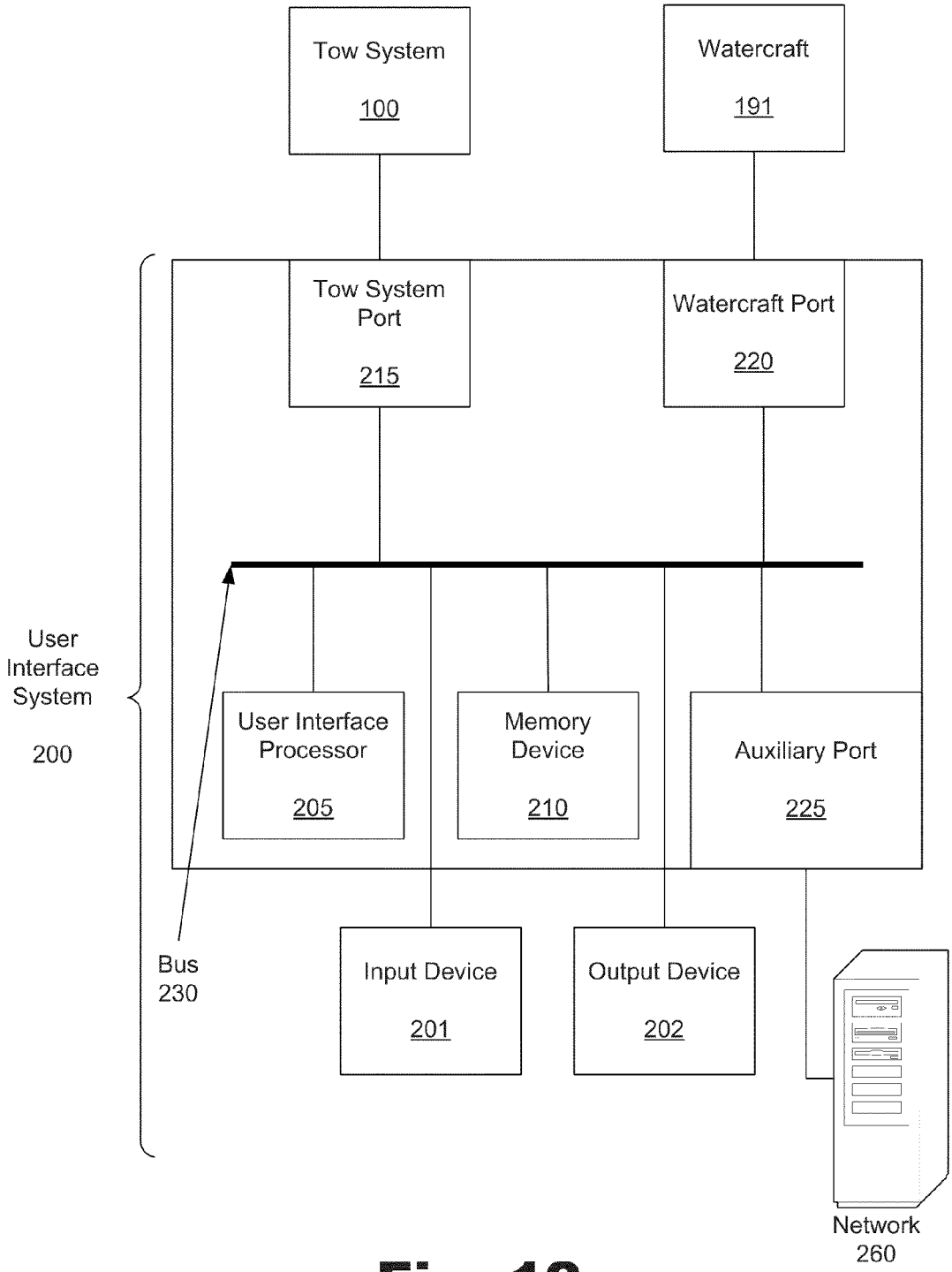
FIG. 12 is a block diagram of the tow system of FIG. 4 incorporating a user interface system according to another embodiment of the present illustrative system and method.

FIG. 12 is a block diagram of the tow system of FIG. 4 incorporating a user interface system according to another embodiment of the present illustrative system and method. In this illustrative embodiment, the user interface system (200) is configured to receive data or instructions via a number of the input devices (201), processes the data and instructions via a user interface processor (205), and output the results to a user via a number of the output devices (202). In this embodiment, the user interface system (200) is also configured to control a number of operating parameters of the tow system (100) and watercraft (FIG. 2, 191).

More specifically, the user interface system (200) of FIG. 12 includes a number of input devices (201) and a number of output devices (202) as described above in connection with FIG. 11. Further, the user interface system (200) includes a processor (205), a number of memory devices (210), a tow system port (215), a watercraft port (220), a number of auxiliary ports (225), and a bus (230). Each of these devices will now be explained in more detail.

The processor (205) may include any central processing unit that carries out the instructions of a computer program stored on, for example, the memory devices (210) or stored external to the user interface system (200). The processor (205) may be any processor used in connection with a general purpose'computer, a special purpose computer, or other programmable data processing apparatus, such that the instructions, which execute via the processor (205) of the user interface system (200), implement the instructions inputted to the user interface system (200) from the input devices (201), the tow system (100), and/or the watercraft (191).

The bus (FIGS. 12 and 13, 230) is any subsystem that transfers data between user interface system (200) components inside the user interface system (200) or between devices such as the user interface system (200), the tow system (100), the watercraft (191), and/or a network (260). The network (260) may include any system of computing devices, computer terminals, audio or visual display devices, or mobile devices such as telephones interconnected by a telecommunication system (wireless communication devices) or cables (wired communication), and used to transmit and receive data. As will be discussed in more in more detail below, the network (260) may also include connectivity to the Internet or an intranet.

The memory devices (210) of the user interface system (200) are configured to store data in connection with the operation of the tow system (100) and watercraft (191) as well as any computer programs used in association with the control of the tow system (100) and watercraft (191) including an operating system. The memory devices (210) also store any computer programs required to control the various devices of the user interface system (200) including the input devices (201), the output devices (202), the tow system port (215), the watercraft port (220), and the auxiliary port (225). The memory devices (210) may include any computer usable or computer readable medium. For example, the memory devices may be, but are not limited to, an electronic, magnetic, optical, electromagnetic, infrared, or semiconductor system, apparatus, device, or propagation medium. More specific examples of the memory devices may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device.

The tow system port (215), watercraft port (220), and auxiliary port (225) may be any interface between the user interface system (200) and other computers or peripheral devices such as the tow system (100), the watercraft (191), or servers supporting the Internet or an intranet. The tow system port (215), watercraft port (220), and auxiliary port (225) may be any parallel or serial port, and may further be configured as plug-and-play ports. More specifically, the tow system port (215), watercraft port (220), and auxiliary port (225) may be USB ports, firewire ports, ethernet ports, PS/2 connector ports, video graphics array (VGA) ports, or small computer system interface (SCSI) ports. The tow system port (215) is configured to provide signal transfer between the user interface system (200) and the tow system (100). Similarly, the watercraft port (220) is configured to provide signal transfer between the user interface system (200) and the watercraft (191). Finally, the auxiliary port (225) is configured to provide signal transfer between the user interface system (200) and other computing devices or servers supporting the Internet or an intranet such as the network (260), and any other device such as external memory devices.

As stated above in connection with FIGS. 11 and 12, the user interface system (200) may include one or more output devices (202) such as a display device. The tow system (100) outputs information to the output devices (202) regarding current working parameters of the tow system (100) including: the activation of one or more safety switches (FIG. 10, 173); the activation of the emergency shut-off switches (FIG. 10, 171); the current working state of the power source (FIG. 10, 196), power train (FIG. 10, 110), and brake assembly (FIG. 10, 120); the transmission of commands from the transmitter assembly (FIG. 10, 160) to the wireless receiver (FIG. 10, 175); the current working state of the ECU (FIG. 10, 170); the amount of towrope (FIG. 4, 149) reeled out; the speed and acceleration of towrope (FIG. 4, 149) reel-in or reel-out; and the name and profile of the rider (FIG. 2, 195); among others. In addition to this information, other parameters may be displayed on the output devices (202) including working parameters of the watercraft (FIG. 2, 191) or any system or subsystem thereof. For example, the output devices (202) may be configured to display information regarding the current speed of the watercraft (FIG. 2, 191), the RPM's of the watercraft's (FIG. 2, 191) motor, and/or the type of watercraft (FIG. 2, 191) to which the tow system (100) is coupled.

Similarly, as stated above in connection with FIGS. 11 and 12, the user interface system (200) may include a number of input devices (201). The input devices may be provided to a user for inputting commands to the tow system (100) and/or watercraft (191). For example, the input devices (201) may be used to instruct the tow system (100) to reel in or reel out the towrope (FIGS. 4 and 5, 149). In this manner, the operator (FIG. 2, 193) of the watercraft (191) or any other person such as a ski instructor may control the tow system (100) for the benefit of, for example, teaching the rider (FIG. 2, 195).

Figure 13:
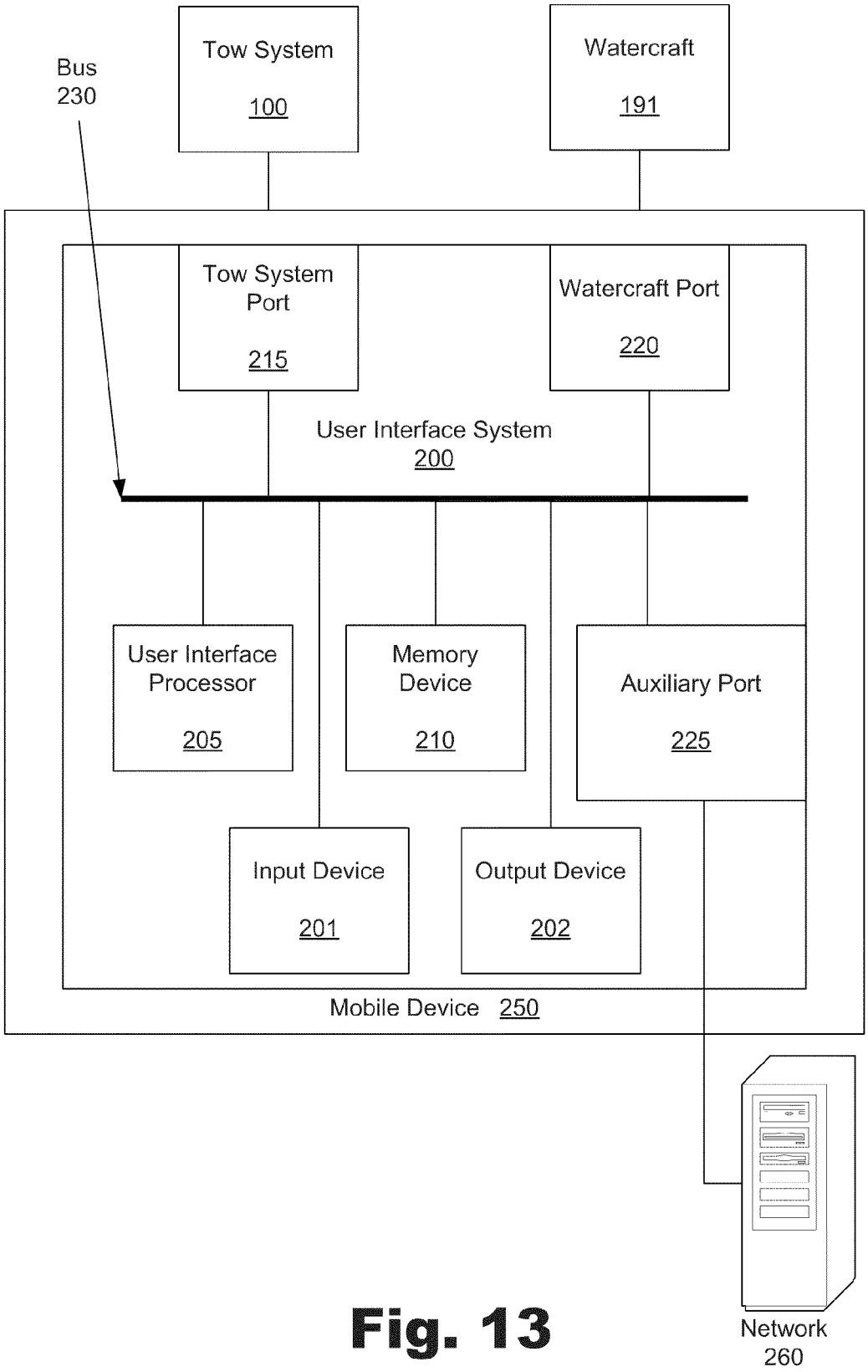
FIG. 13 is a block diagram of the tow system of FIG. 4 incorporating a user interface system according to another embodiment of the present illustrative system and method.

In connection with FIG. 13, the user interface system (200) may be embodied in a mobile device (250) such as a touch screen display device, a mobile telecommunications device, a personal digital assistant (PDA), a handheld computer, a laptop computer, a desktop computer, or a web-based user interface. More specifically, the user interface system (200) may be embodied in a device such as a touch screen mobile telecommunications device that is Internet and/or multimedia enabled or otherwise connected to a network. Some examples of such as devices may be an iPhone® developed by Apple, Inc™, the BlackBerry® Storm® developed by Research In Motion™ or other smart phones. In this embodiment, any necessary computer code required to operate the user interface (200) in connection with the tow system (100) and watercraft (191) may be embodied within the memory devices (210) at the point of sale of the user interface system (200), or may be downloaded to the user interface system (200) via the network (260). For example, in one illustrative embodiment, a user may download the computer code configured to provide electronic communication between the user interface system (200), the tow system (100), and the watercraft (191) via the network (260).

In the embodiment of FIGS. 12 and 13, the user interface may further be configured to connect to a number of web pages via the network (260). Thus, in this embodiment, a user may access a web page that allows for the creation, updating, and printing of rider (FIG. 2, 195) profiles and statistics. For example, the web page may allow for the creation, updating, and printing of a new rider profile that includes, for example, the rider's (FIG. 2, 195) name, age, sex, or water skiing ability (e.g. levels of skill such as expert, intermediate, or novice), among others. Further, the web page may allow for the updating of creation, updating, and printing of a boat profile. For example, the boat profile may include the various specifics of the watercraft (191) such as the type and size of the watercraft (191), the type and size of the watercraft's (191) engine, whether the watercraft's (191) engine is an inboard, an outboard, or an inboard/outboard engine, the watercraft's (191) engine performance, and the distance from the watercraft's (191) tower (FIGS. 2, 3, and 4, 131) to the stern or back deck of the watercraft (191), among others. Thus, a web page may be utilized by the user interface system (200) to provide information and instructions to the user interface system (200) regarding the operation of the tow system (100) and watercraft (191).

Figure 14:
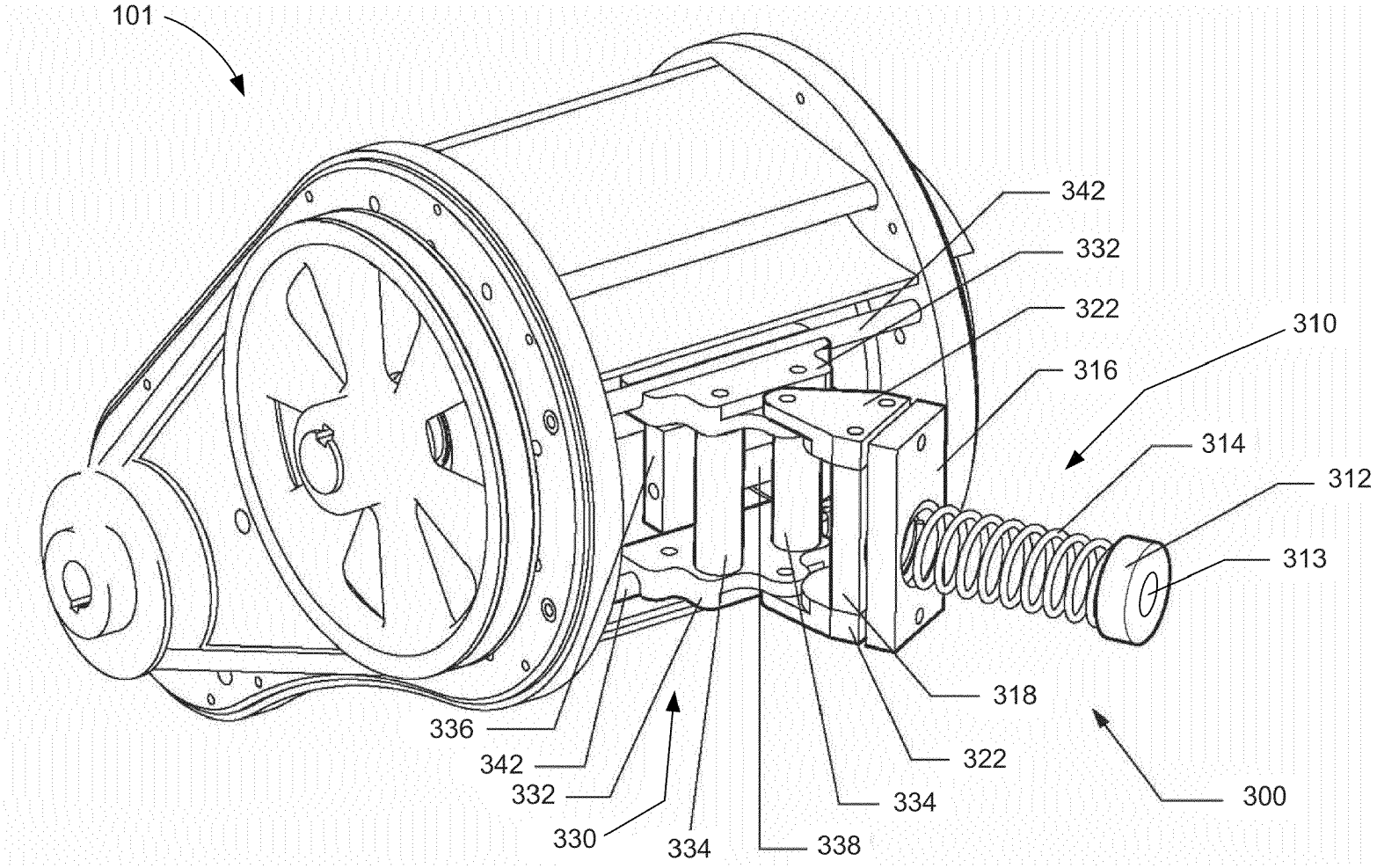
FIG. 14 is a perspective view of a safety switch assembly of the towrope winch of FIG. 4, according to an embodiment of the present illustrative system and method.

Turning now to FIG. 14, a perspective view of a safety switch assembly (300) of the towrope winch (101) of FIG. 4, according to an embodiment of the present illustrative system and method is depicted. FIG. 14 shows that the safety switch assembly (300) comprises a compression shutoff switch (310) and a safety switch (330) that acts like a dead-man switch to enable winch operation only when a rider is actually using the towrope to ride a board. Each of these elements will be discussed in more detail below.

The safety switch assembly (300) can alternatively replace the fairlead assembly (FIG. 4,150) or be coupled to the towrope winch (101) along with the fairlead assembly (FIG. 4, 150). In one illustrative embodiment, if the safety switch assembly (300) is used in conjunction with the fairlead assembly (FIG. 4,150), the safety switch assembly (300) is attached to the fairlead assembly (FIG. 4,150) so as to also allow the towrope (FIGS. 2, 4, and 5, 149) to be fed into the towrope winch (FIGS. 2, 3, and 14, 101). The safety switch assembly (300) may be coupled to, for example, the fairlead bracket (FIG. 4, 151) of the fairlead assembly (FIG. 4,150) via, for example, gluing, welding, riveting, or via a number of screws or a number of bolts and nuts, or other fasteners. Additionally, in another illustrative embodiment the safety switch assembly (300) can incorporate either the compression shutoff switch (310) or safety switch (330), or both.

Figure 15:
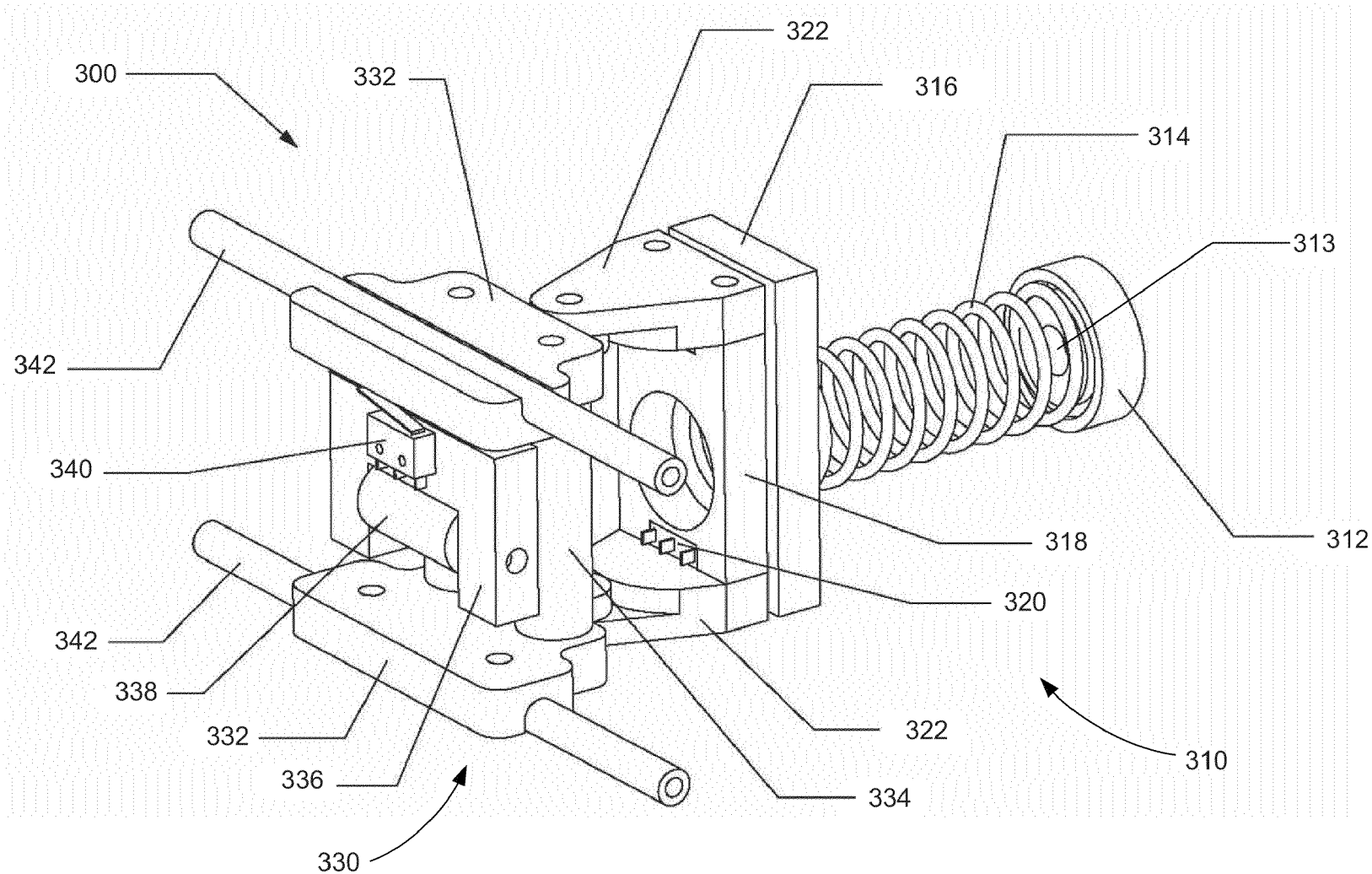
FIG. 15 is a perspective view of the safety switch assembly comprising the compression shutoff switch and the tension release shutoff switch of FIG. 14, according to an embodiment of the present illustrative system and method.
Figure 16:
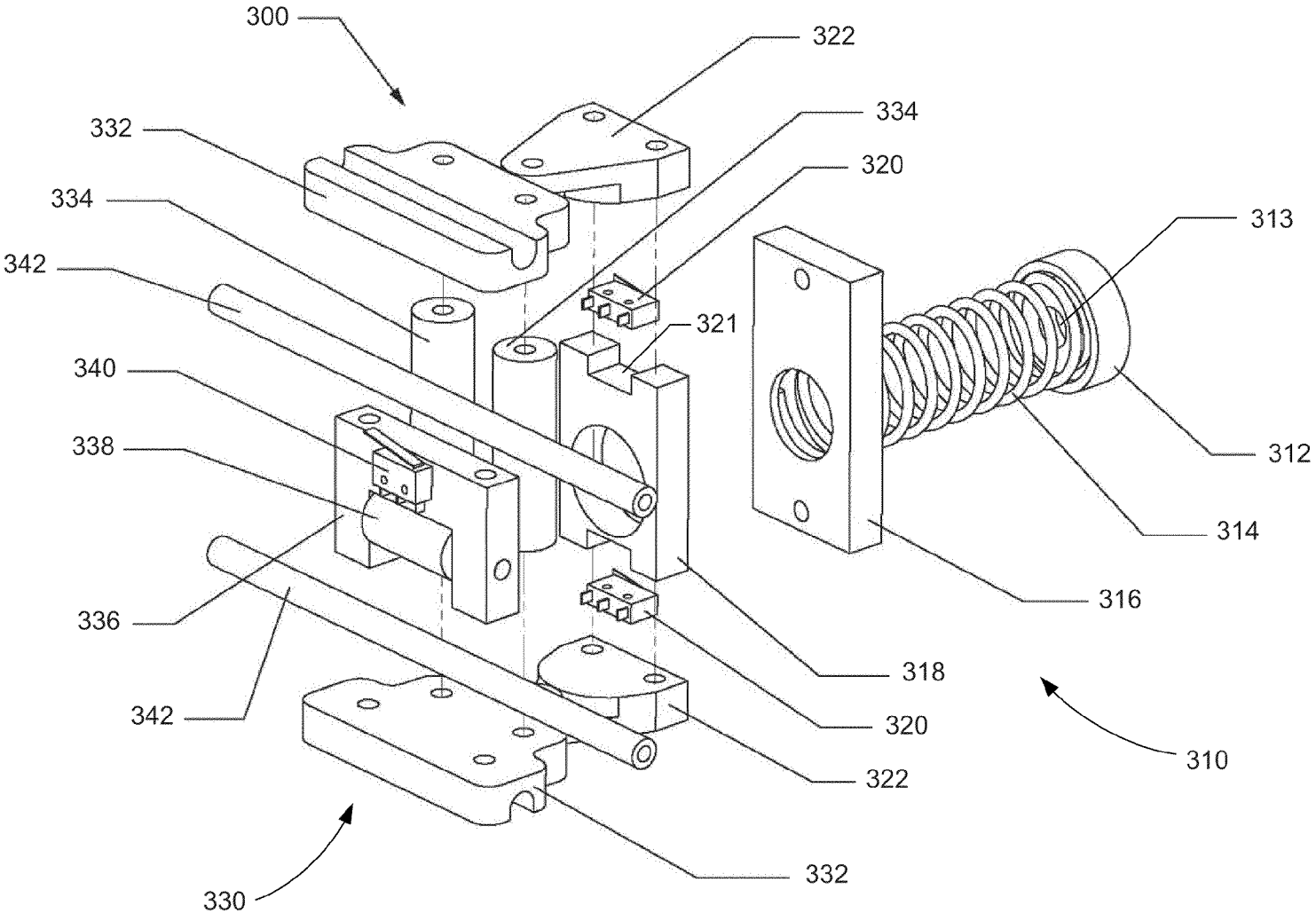
FIG. 16 is an exploded view of the safety switch assembly of FIG. 15, according to an embodiment of the present illustrative system and method.

As discussed, FIG. 14 depicts a compression shutoff switch (310). The compression shutoff switch (310) will now be described in more detail in connection with FIGS. 14, 15, and 16. FIG. 15 is a perspective view of the safety switch assembly (300) comprising the compression shutoff switch (310) and the safety switch (330) of FIG. 14, according to an embodiment of the present illustrative system and method. FIG. 16 is an exploded view of the safety switch assembly of FIG. 15, according to an embodiment of the present illustrative system and method. The compression shutoff switch (310) may include a spring cap (312), a spring (314), a compression block (316), a compression switch block (318), a number of compression switches (320), and a number of pivot blocks (322). Each of these will now be described in more detail.

The spring cap (312) and spring (314) are configured to receive and direct the towrope being fed into the towrope winch (FIGS. 2, 3, and 14, 101). The spring cap (312) may be made of metal, plastic or other materials which will allow a towrope (FIGS. 2, 4, and 5, 149) to slide across its surfaces. A spring cap aperture (313) is defined in the spring cap (312) into which the towrope (FIGS. 2, 4, and 5, 149) is guided. This size of the aperture (313) defined in the spring cap (312) is of sufficient size to allow the towrope (FIGS. 2, 4, and 5, 149) to slide easily through, but not too large so as to permit the towrope (FIGS. 2, 4, and 5, 149) to bunch up or entangle inside the spring cap (312) or spring (314). Additionally, the spring cap aperture (313) should not be too large so as to allow foreign objects such as hair, fingers, or clothing to slide into either the spring cap (312) or spring (314).

The spring (314) may be made of some resilient material, and may be made of metal. The proximal end of the spring (314) is coupled to the spring cap (312). For example, the spring cap (312) may be coupled to the spring (314) via, gluing, welding, riveting, or via a number of screws or a number of bolts and nuts, or other fasteners. In one illustrative embodiment, an additional circular channel is defined in the body of the spring cap (312) into which the proximal end of the spring (314) may tightly fit.

The spring (314) is configured to resistively bend a certain degree so as to allow the towrope (FIGS. 2, 4, and 5, 149) to be wound into the towrope winch (FIGS. 2, 3, and 14, 101) from a number of directions. For example, if the rider (FIG. 2, 195) is being pulled generally off to the port side of the watercraft (FIGS. 2, 11, 12, and 13, 191) the spring (314) will bend horizontally and vertically enough to accommodate the tension created at that angle or direction. This is done so as to not create excessive friction between the towrope (FIGS. 2, 4, and 5, 149) and the spring cap (312) or spring (314). Additionally, if the rider (FIG. 2, 195) is jumping the wake created by the watercraft (FIGS. 2, 11, 12, and 13, 191), then the spring (314) will further bend vertically to accommodate the change in angle. The spring (314) therefore prevents general wear and tear on the towrope (FIGS. 2, 4, and 5, 149) and thereby will increase the lifetime of the towrope (FIGS. 2, 4, and 5, 149).

The compression shutoff switch (310) further includes a compression block (316) to which the distal end of the spring (314) is coupled. The compression block (316) may be made of metal or any other suitable material resistant to bending. A hole is defined in the compression block (316) into which the towrope (FIGS. 2, 4, and 5, 149) passes through when being fed into the towrope winch (FIGS. 2, 3, and 14, 101). The distal end of the spring (314) is then coupled to the compression block (316) over the hole so as to continue the channel formed inside the spring cap aperture (313) and spring (314). The compression block (316) is coupled to the distal end of the spring (314) via, for example, gluing, welding, riveting, or via a number of screws or a number of bolts and nuts, or other fasteners. In one illustrative embodiment, a circular channel is defined in the body of the compression block (316) wherein the distal end of the spring (314) may be tightly fitted and secured.

The compression shutoff switch (310) further includes a compression switch block (318) and a number of compression switches (320). A hole is also defined in the compression switch block (318) into which the towrope (FIGS. 2, 4, and 5, 149) passes through when being fed into the towrope winch (FIGS. 2, 3, and 14, 101). Furthermore, a number of recesses (FIG. 16, 321) are defined in the compression switch block (318) into which the compression switches (320) are placed. In one illustrative embodiment, two recesses are located at opposite ends of the compression switch block (318) with a compression switch (320) placed inside each.

The compression switches (320) are placed into the recesses (FIG. 16, 321) in such a way that the contact members of the individual compression switches (320) are exposed to contact with the compression block (316). As will be described in more detail below, the compression block (316), when pressed against the compression switch block (318), compresses the contact members of the compression switches (320) so as to complete an electrical circuit and thereby disable the towrope winch (FIGS. 2, 3, and 14, 101). The compression switch block (318) is coupled to the compression block (316) in any manner so as to allow the compression block (316) to be compressed into the compression switch block (318). In one illustrative embodiment, the compression block (316) is coupled to the compression switch block (318) by a number of springs.

In another illustrative embodiment, a number of corresponding holes are defined in the compression block (316) and compression switch block (318) through which a number of spring bars or spring rods may fit. The spring bars or spring rods comprise a bar or rod used to couple the compression block (316) to the compression switch block (318) while still allowing the compression block (316) to be selectively compressed against the compression switch block (318) by the use of a spring. Specifically, the distal end of the rod is fitted into a hole defined in the compression switch block (318) and secured therein by, for example, gluing or welding. A spring is then placed over the bar or rod so that the rod protrudes through the longitudinal axis of the spring. The rod or bar is then passed through a hole defined in the compression block (316) and the proximal end is then capped with a stop such as a nut so that the compression block (316) cannot be uncoupled from the compression switch block (318). For added stability, any number of spring bars or spring rods may be used.

The compression shutoff switch (310) further includes a number of pivot blocks (322). These pivot blocks (322) may be made of metal or any other suitable material resistant to bending. The pivot blocks (322) are coupled to the compression switch block (318) via gluing, welding, riveting, or via a number of screws or a number of bolts and nuts, or other fasteners.

The pivot blocks (322) additionally couple the compression shutoff switch (310) to either the safety switch (330) or directly with the towrope winch (FIGS. 2, 3, and 14, 101). Additionally, the pivot blocks (322) allow the towrope (FIGS. 2, 4, and 5, 149) to be wound into the towrope winch (FIGS. 2, 3, and 14, 101) from any horizontal direction much like the spring (314). The pivot blocks (322) pivot horizontally enough to accommodate the tension created at any specific angle at which the rider (FIG. 2, 195) is being pulled behind the watercraft (FIGS. 2, 11, 12 and 13, 191). This is done so as to not create excessive friction against the towrope (FIGS. 2, 4, and 5, 149). The pivot blocks (322) therefore prevent general wear and tear on the towrope (FIGS. 2, 4, and 5, 149) and thereby will increase the towrope's (FIGS. 2, 4, and 5, 149) lifetime.

As discussed earlier in connection with FIG. 10, the compression shutoff switch (310) is one of many possible safety switches (FIG. 10, 173) which is in electrical communication with the ECU (FIG. 10, 170). In one illustrative embodiment, activation of one or more of the compression switches (320) causes the ECU (FIG. 10, 170) to shut off a number of devices attached to the towrope winch (FIGS. 2, 3, and 14, 101). For example, upon activation of one of the compression switches (320), the ECU (FIG. 10, 170) causes the motor (FIGS. 4, 6, and 10, 111) to stop reeling the towrope (FIGS. 2, 4, and 5, 149) in or out.

In another illustrative embodiment, the ECU (FIG. 10, 170) may cause the brake assembly (FIGS. 4, 7, 8, and 10, 120) to engage. Specifically, engagement of the brake assembly (FIGS. 4, 7, 8, and 10, 120) causes the solenoid body (FIGS. 4, 7, and 8, 123) to move the solenoid plunger (FIGS. 4, 7, and 8, 124) such that the solenoid plunger (FIGS. 4, 7, and 8, 124) causes the pawl (FIGS. 7 and 8, 122) to engage with the ratchet wheel (FIGS. 4, 7, and 8, 121). This thereby stops the rotational movement of the reel drum (FIGS. 4, 5, and 7, 142) as described above. In yet another illustrative embodiment, the ECU (FIG. 10, 170) may cause the motor (FIGS. 4, 6, and 10, 111) to stop reeling the towrope in or out as well as cause the brake assembly (FIGS. 4, 7, 8, and 10, 120) to engage as described above.

FIG. 10 schematically depicts an open safety switch (FIG. 10, 173) circuit. The ECU (FIG. 10, 170) may however shut off a number of devices attached to the towrope winch (FIGS. 2, 3, and 14, 101) when either a circuit is opened or closed. In one illustrative embodiment, when the contact member of a compression switch (320) comes in contact with the compression block (316), a circuit is closed on the compression switch (320) which, in turn, interrupts or diverts the electrical current flowing through the tow system (FIGS. 4, 11, 12, and 13, 100). The ECU (FIG. 10, 170) then signals a number of devices attached to the towrope winch (FIGS. 2, 3, and 14, 101) to disengage.

Another embodiment of the safety switch (330) may comprise a light curtain in place of or along with the compression switches (320). The light curtain consists of a photo transmitter and receiver or an array of such transmitter/receiver pairs. The light curtain produced by the transmitters is interrupted where the towrope passes through the light curtain. This interruption in the light between the transmitters and receivers can be used to detect the angle of the rope. If that angle is within a range indicative of use of the angle outside the watercraft, the winch system may be enabled. If that angle indicates that the rope is hanging within the watercraft, the winch system can be automatically disabled for safety reasons.

Figure 17:
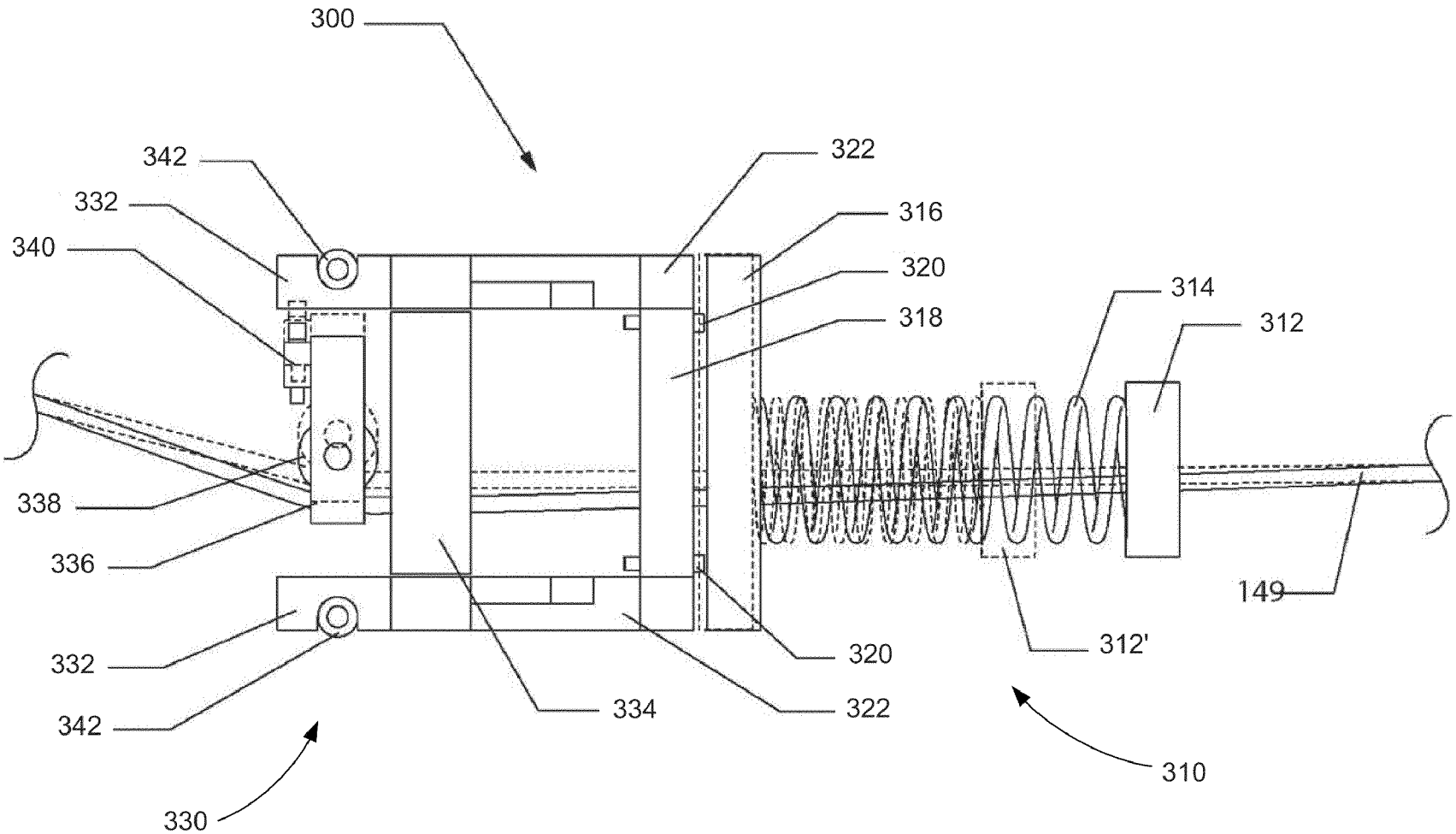
FIG. 17 is a side view of the safety switch assembly of FIGS. 14, 15, and 16 showing the actuation of both the compression shutoff switch and a tension release shutoff switch according to an embodiment of the present illustrative system and method.

Operation of the compression shutoff switch (310) will now be discussed with reference to FIG. 17. FIG. 17 is a side view of the safety switch assembly of FIGS. 14, 15, and 16 showing the actuation of both the compression shutoff switch (310) and a safety switch (330) according to an embodiment of the present illustrative system and method. As can be seen in FIG. 17, the towrope (149) is fed through the compression shutoff switch (310) so that it passes through the hole defined in the compression switch block (318) and further passes through the hole defined in the compression block (316). Finally, the towrope (149) passes through the channel defined by the longitudinal axis of the spring (314) and spring cap aperture (313) as described above. The towrope (149) would then continue to the towrope handle assembly (FIG. 4, 199).

The compression shutoff switch (310) is designed to relay a signal to the ECU (FIG. 10, 170) to shut down a number of systems of the towrope winch (FIGS. 2, 3, and 14, 101) when any foreign object has been pulled into the towrope winch (FIGS. 2, 3, and 14, 101). For example, the compression shutoff switch (310) will relay a signal to the ECU (FIG. 10, 170) to shut down the motor (FIGS. 4 and 6, 111) or engage the brake assembly (FIGS. 3, 4, 7, 8, and 10, 120) when a finger, hair or towel has been pulled into the towrope winch (FIGS. 2, 3, and 14, 101) along with the towrope (149).

When a foreign object is pulled into the towrope winch (FIGS. 2, 3, and 14, 101) it will come in contact first with the proximal end of the spring cap (312). The spring cap (312) will help to block the foreign object from entering the channel defined by the longitudinal axis of the spring (314) and spring cap aperture (313). As a result, the spring will compress against the foreign object being blocked by the spring cap (312) and the spring cap (312) will be compressed and displaced in the direction towards the towrope winch (FIGS. 2, 3, and 14, 101). The compressed spring (314) and spring cap (312') creates a restoring force, which is exerted on both the foreign object and the compression block (316). However, because the towrope (149) is being pulled into the towrope winch (FIGS. 2, 3, and 14, 101), the restoring force of the spring is acted mostly upon the compression block (316) making it move to the left with respect to the embodiment depicted in FIG. 17. In other words, the restoring force is sufficient to move the compression block (316) towards the compression switch block (318). When the compression block (316) comes in close contact with the compression switch block (318), the contact members of the compression switches (320) close the circuit on the compression switch (320) and a signal is sent to the ECU (FIG. 10, 170) which, as discussed earlier, shuts of either the motor (FIGS. 4 and 6, 111), engages the brake assembly (FIGS. 3, 4, 7, 8, and 10, 120), or both.

As discussed earlier, FIG. 14 depicts a safety switch (330). The safety switch (330) will now be described in more detail in connection with FIGS. 14, 15, and 16. FIG. 15 is a perspective view of the safety switch assembly (300) comprising the compression shutoff switch (310) and the safety switch (330) of FIG. 14, according to an embodiment of the present illustrative system and method. FIG. 16 is an exploded view of the safety switch assembly of FIG. 15, according to an embodiment of the present illustrative system and method.

Generally, the function of the safety switch (330) is to disable operation of the winch system unless the towrope is actually in use with a rider being towed behind the watercraft.

In various embodiments, the safety switch (330) relies on the rope tension created by a rider within a specific range of angles, indicating that the tension is coming from outside the watercraft, to move a slider switch that then enables operation of the winch. In such examples, the absence of tension on the rope within a specified range of angles will allow the slider, under the influence of gravity, to move downward into an inoperative position. The slider may interrupt power to the winch when allowed to move downward into the inoperative position.

A specific example of the safety switch (330) will now be described. This safety switch (330) may include a number of slide blocks (332), a number of vertical rollers (334), a block (336), a number of horizontal rollers (338), a number of switches (340), and a number of slide guides (342). Each of these will now be described in more detail.

The vertical rollers (334) are configured to vertically stabilize the towrope (FIGS. 2, 4, and 5, 149) as it is reeled in or out of the towrope winch (FIGS. 2, 3, and 14, 101). Therefore, the vertical rollers (334) are generally vertical and parallel to each other. In one illustrative embodiment, the vertical rollers (334) are spaced horizontally apart in such a way so as to allow only the towrope (FIGS. 2, 4, and 5, 149) to pass therethrough. This additionally prevents foreign objects from being pulled into the towrope winch (FIGS. 2, 3, and 14, 101) as the winch reels in the towrope (FIGS. 2, 4, and 5, 149). In one illustrative embodiment, the vertical rollers (334) are made of a rigid material such as plastic or metal which are smoothed in order to subject the towrope (FIGS. 2, 4, and 5, 149) to the least amount of wear and tear as possible.

As will be discussed later, the vertical rollers (334) are configured to be coupled to the slide blocks (332). For example, the vertical rollers (334) may be coupled to the slide blocks (332) via gluing, welding, riveting, or via a number of screws or a number of bolts and nuts, or other fasteners. In one illustrative embodiment, a hole may be defined along the longitudinal axis of the vertical rollers (334) through which a number of roller pins may be inserted. The slide blocks (332) may then have a number of recesses defined therein into which the roller pins may be inserted. Therefore, the vertical rollers (334) may rotate freely around the roller pins and thereby subject the towrope (FIGS. 2, 4, and 5, 149) to the least amount of wear and tear possible.

The safety switch (330) further comprises a block (336), a number of horizontal rollers (338) and a number of switches (340). The block (336) is configured to be coupled to both the horizontal rollers (338) and switches (340). Specifically, a recess is defined in the lower portion of the block (336) into which a horizontal roller (338) may fit. In one illustrative embodiment, a hole may be defined along the longitudinal axis of the horizontal roller (338) through which a roller pin or axle may be inserted. A number of recess may be defined on the inside of the recess of the block (336) into which the roller pin may fit. Therefore, the horizontal roller (338) may rotate freely around the roller pin and thereby subject the towrope (FIGS. 2, 4, and 5, 149) to the least amount of wear and tear possible.

The switches (340) are also configured to be coupled to the block (336) in such a way that the contact members of the individual switches (340) extend past the top of the block (336). As will be discussed later, this allows the switches (340) to close a circuit when actuated, thereby signaling to the ECU (FIG. 10, 170) that tension, within a specific range of angles indicating a rider is being towed outside the watercraft, is being exerted on the towrope (FIGS. 2, 4, and 5, 149. Additionally or in the alternative, as will be discussed later in more detail, the circuits on the switches (340) are further configured to be closed only when force is applied to the horizontal roller (338) by the towrope (FIGS. 2, 4, and 5, 149) within a specified range of angles. This additionally provides a means by which the towrope winch (FIGS. 2, 3, and 14, 101) can be deactivated via the ECU (FIG. 10, 170) when the towrope (FIGS. 2, 4, and 5, 149) is not being used by a rider (FIG. 2, 195).

Another illustrative embodiment of the safety switch (330) may comprise a light curtain in place of or along with the switches (340) in order to detect at what angle tension is being placed on the towrope (FIGS. 2, 4, and 5, 149) and block (336). The light curtain consists of a photo transmitter and receiver. The transmitter is configured to send a number of parallel infrared light beams to a receiver containing a number of photoelectric cells. The photoelectric cells are configured to detect the specific pulse and frequency of light emitted by the transmitter. If, however, the specific infrared light is not detected, for example when an object has broken the optical path of the beam, then the light curtain sends a signal to a safety relay which would then signal the ECU (FIG. 10, 170) to shut off a number of devices attached to the towrope winch (FIGS. 2, 3, and 14, 101). In one illustrative embodiment, the light curtain would be installed in such a way so as to detect whether the block (336) has been compressed against the slide blocks (322). Specifically, the light guide can be situated in such a way so that when tension is released on the towrope (FIGS. 2, 4, and 5, 149), the block (336) breaks the optical path of the light curtain. The light curtain would therefore be configured to only send a signal to the electronic control unit (ECU) (FIG. 10, 170) when tension has been released on the towrope (FIGS. 2, 4, and 5, 149) and the rider (FIG. 2, 195) has fallen into the water.

Still a further embodiment of the safety switch (330) may comprise an electrical resistive or capacitive touch sense system configured to detect whether or not tension is being placed on the towrope (FIGS. 2, 4, and 5, 149) and block (336). In one illustrative embodiment, an electrical resistive or capacitive touch sense system can be attached to the underside of the slide block (322). The resistive or capacitive touch sensory system can then detect when contact is made between the slide block (322) and the block (336). Once the resistive or capacitive touch sensory system has detected the block (336) has been compressed against the slide block (322), then it will send a signal to the ECU (FIG. 10, 170). The ECU (FIG. 10, 170) will then shut off a number of devices attached to the towrope winch (FIGS. 2, 3, and 14, 101) as described above.

The block (336), having the horizontal rollers (338) and switches (340) coupled thereto, is then coupled to the slide blocks (332) in such a way so as to allow the block (336) to freely move in the vertical direction. In one illustrative embodiment, the block (336) may be coupled to the slide blocks (332) with a number of springs. In another illustrative embodiment, a housing may be provided to support the block (336). A number of channels may be defined in the housing to allow the sides of the block (336) to be placed therein. This housing would then be coupled to the slide blocks (332) via, for example, gluing, welding, riveting, or via a number of screws or a number of bolts and nuts, or other fasteners.

In yet another illustrative embodiment, a number of corresponding holes are defined in the slide blocks (332) and block (336) through which a number of spring bars or spring rods may fit. The spring bars or spring rods comprise a bar or rod used to couple the block (336) to the slide blocks (332) while still allowing the block (336) to be selectively compressed against the slide blocks (332) by the use of a spring. Specifically, the distal end of the rod is fitted into a hole defined in the block (336) and secured therein by, for example, gluing or welding. A spring is then placed over the bar or rod so that the rod protrudes through the longitudinal axis of the spring. The rod or bar is then passed through a hole defined in the slide blocks (332) and the proximal end is then capped with a stop such as a nut so that the block (336) cannot be uncoupled from the slide blocks (332). For added stability, any number of spring bars or spring rods may be used.

The safety switch (330) further comprises a number of slide blocks (332) and a number of slide guides (342). In one illustrative embodiment, a slide block (332) is configured to be coupled to the top and bottom of the vertical rollers (334) as well as the block (336). Therefore, the slide blocks (332) additionally provide structure and support to the safety switch (330) and vertical rollers (334).

The slide blocks (332) are further coupled to a number of slide guides (342). This therefore allows the safety switch (330) to slide horizontally across the face of the towrope winch (FIGS. 2, 3, and 14, 101) while the towrope winch (FIGS. 2, 3, and 14, 101) is reeling the towrope (FIGS. 2, 4, and 5, 149) in or out. The slide guides (342) are made of a rigid material so as to hold the weight of the safety switch (330) as well as overcome any force exerted on the safety switch (330) by the towrope (FIGS. 2, 4, and 5, 149) being pulled on by the rider (FIG. 2, 195).

In one illustrative embodiment, a channel is defined in each slide block (332) into which a slide guide (342) may fit. The channel's diameters are small enough to allow the slide guides (342) to fit tightly inside, but still large enough to allow the least amount of friction between the slide blocks (332) and slide guides (342). This allows the safety switch (330) to freely move in the horizontal direction while a rider (FIG. 2, 195) is being pulled by the watercraft (FIGS. 2, 11, 12 and 13, 191).

In another illustrative embodiment, the channels into which the slide guides (342) fit may be open on one side so as to reduce the friction created between the slide guides (342) and slide blocks (332) even further. Additionally, the slide guides (342) and channels defined in the slide blocks (332) may be coated with a friction resistant coating such as polytetrafluoroethylene (PTFE) sold under the trademark TEFLON® produced by, for example, E. I. du Pont de Nemours and Company (DuPont).

Additionally, the slide blocks (332) are configured to allow the compression shutoff switch (310) to be mounted thereon. A discussed above, the pivot blocks (322) of the compression shutoff switch (310) are configured to attach either to the slide blocks (322) of the safety switch (330) or directly to the towrope winch (FIGS. 2, 3, and 14, 101). However, when the compression shutoff switch (310) is coupled to the safety switch (330), the pivot blocks (322) are coupled to the slide blocks (332) by for example, riveting, or via a number of screws or a number of bolts and nuts, or other fasteners. In one illustrative embodiment, a hole is defined in both the pivot blocks (322) and slide blocks (332) through which a screw and nut may be placed to secure the pivot blocks (322) to the slide blocks (332).

The slide guides (342) are coupled to either the towrope winch (FIGS. 2, 3, and 14, 101) or the fairlead assembly (FIGS. 3 and 4, 150). In one illustrative embodiment, the slide guides (342) are coupled to the towrope winch (FIGS. 2, 3, and 14, 101) by, for example, gluing, welding, riveting, or via a number of screws or a number of bolts and nuts, or other fasteners.

Operation of the safety switch (330) will now be discussed with reference to FIG. 17. FIG. 17 is a side view of the safety switch assembly of FIGS. 14, 15, and 16 showing the actuation of both the compression shutoff switch (310) and the safety switch (330) according to an embodiment of the present illustrative system and method.

As depicted in FIG. 17, the towrope (149) is fed through the safety switch assembly (300) so that it abuts the horizontal (338) and vertical rollers (334) of the safety switch (330). The towrope (149) then passes through the hole defined in the compression switch block (318), passes through the hole defined in the compression block (316), and finally passes through the channel defined by the longitudinal axis of the spring (314) and spring cap aperture (313) as described above. The towrope (149) then continues on to the towrope handle assembly (FIG. 4, 199).

However, as described above the safety switch assembly (300) may comprise the compression shutoff switch (310) or the safety switch (330) or both. Where only the compression shutoff switch (310) is implemented, the towrope (149) would only pass through the hole defined in the compression switch block (318), pass through the hole defined in the compression block (316), and finally pass through the channel defined by the longitudinal axis of the spring (314) and spring cap aperture (313) as described above. The towrope (149) would then continue to the towrope handle assembly (FIG. 4, 199).

Additionally, where only the safety switch (330) is implemented, the towrope (149) would only abut the horizontal (338) and vertical rollers (334) and then continue to the towrope handle assembly (FIG. 4, 199). Therefore, although FIG. 17 depicts the use of both a compression shutoff switch (310) and a safety switch (330) together, it can be appreciated as well that either one can be utilized separate from the other.

As discussed earlier, the towrope (FIGS. 2, 4, and 5, 149) comprises a towrope handle assembly (FIG. 4, 199). The towrope handle assembly (FIG. 4, 199) further comprises, in pertinent, a reel-out button (FIGS. 4 and 9, 163) and a reel-in button (FIGS. 4 and 9, 161). The features and their advantages have already been discussed and will not be repeated here, however it is important to note that with these features, comes a need to prevent their misuse or accidental use during operation of the towrope winch (FIGS. 2, 3, and 14, 101). More specifically, it is important to include a safety feature or features which would prevent a user from activating the towrope winch (FIGS. 2, 3, and 14, 101) from the inside the watercraft (FIG. 2, 191). Operation of the towrope winch (FIGS. 2, 3, and 14, 101) by pressing either the reel-in button (FIGS. 4 and 9, 161) or reel-out button (FIGS. 4 and 9, 163) while the towrope handle assembly (FIG. 4, 199) is inside the watercraft (FIG. 2, 191) may result in injury to the operator or others in the watercraft (FIG. 2, 191). The safety switch (330) system and method helps provides for such a need and will be discussed in detail in relation to FIGS. 17 and 18.

With reference to FIG. 17, the towrope (149) is fed through the safety switch (330) and abuts both the horizontal roller (338) and vertical rollers (334). While the towrope winch (FIGS. 2, 3, and 14, 101) is in use, the block (336) is pressed against the underside of the top slide block (322). Specifically, when a rider (FIG. 2, 195) is being pulled behind the watercraft, a force is placed on the horizontal roller (338) when tension is applied to the towrope (FIGS. 2, 4, and 5, 149). When this happens, the contact arm of the switch (340) closes the circuit, and a signal is sent to the ECU (FIG. 10, 170) notifying the ECU (FIG. 10, 170) that a rider (FIG. 2, 195) may be currently pulling on the towrope (FIGS. 2, 4, and 5, 149) or otherwise engaged in a water sport.

In one illustrative embodiment, the switch (340) may be configured to send a signal to the ECU (FIG. 10, 170) only when a predetermined amount of force is exerted on the horizontal roller (338) via tension placed on the towrope (FIGS. 2, 4, and 5, 149). In another embodiment, the switch (340) may be configured to send a signal to the ECU (FIG. 10, 170) only when force is applied to the horizontal roller (338) at a predetermined angle. Still, in another embodiment, the switch (340) may be configured to send a signal to the ECU (FIG. 10, 170) when both a predetermined amount of force from the towrope (FIGS. 2, 4, and 5, 149) is applied to the horizontal roller (338) and when that force is applied to the horizontal roller (338) at a predetermined angle.

The predetermined amount of force applied to the horizontal roller (338), and in turn to the switch (340), will vary greatly depending on a number of factors. These factors may include the angle of the towrope (FIGS. 2, 4, and 5, 149) leaving the safety switch (330), the angle of the towrope entering the safety switch (330), the type of hardware and materials used in that hardware, and the weight of the rider (FIG. 2, 195) among others. The force being placed on the horizontal roller (338) is merely one way a signal can be sent to the ECU (FIG. 10, 170) confirming that operation of the towrope winch (FIGS. 2, 3, and 14, 101) should be allowed. Therefore, if force is indeed placed on the horizontal roller (338) thereby activating the switch (340), the ECU (FIG. 10, 170) may allow activation of the reel-out button (FIGS. 4 and 9, 163) and reel-in button (FIGS. 4 and 9, 161) based on that condition. As discussed earlier, however, this may not necessarily be the only condition to be met before the towrope winch (FIGS. 2, 3, and 14, 101) can be operated.

The predetermined angle at which the switch (340) may be activated also may vary depending on a number of factors such as the vertical position of towrope winch (FIGS. 2, 3, and 14, 101), the distance from the tower (FIGS. 1 and 2, 131) to the back of the boat, the length of towrope (FIGS. 2, 4, and 5, 149) being used, among others. In one illustrative embodiment, the angle at which the switch (340) is activated, thereby allowing use of the towrope winch (FIGS. 2, 3, and 14, 101), can be from 0 degrees to −75 degrees if 0 degrees is measured from the horizontal position of the towrope winch (FIGS. 2, 3, and 14, 101) resting on the tower (FIGS. 1 and 2, 131). These angles of the towrope (FIGS. 2, 4, and 5, 149) exerting force on the horizontal roller (338) is another way a signal can be sent to the ECU (FIG. 10, 170) confirming that operation of the towrope winch (FIGS. 2, 3, and 14, 101) should be allowed. This safety feature further prevents operation of the towrope winch (FIGS. 2, 3, and 14, 101) when a person inside the watercraft (FIG. 2, 191) either purposefully or accidentally exerts tension on the towrope (FIGS. 2, 4, and 5, 149). Because the person would be standing from the deck of the boat when the tension is applied, the angle created by the towrope (FIGS. 2, 4, and 5, 149) between the person and the towrope winch (FIGS. 2, 3, and 14, 101) exceeds the threshold of allowable angle at which the switch (340) will indicate to the the ECU (FIG. 10, 170) that operation of the towrope winch (FIGS. 2, 3, and 14, 101) is allowed. Therefore, injury to the person will not occur because the towrope winch (FIGS. 2, 3, and 14, 101) will not be activated.

In one illustrative embodiment, the allowable angle can be adjusted. This allows a user to adjust the allowable angles so that the rider (FIG. 2, 195) is not allowed to reel-in the towrope (FIGS. 2, 4, and 5, 149) too close to the watercraft (FIG. 2, 191). This prevents the rider (FIG. 2, 195) from accidentally reeling in the towrope (FIGS. 2, 4, and 5, 149) to the point where he can be injured by the watercraft's (FIG. 2, 191) propeller.

The angle at which the towrope (FIGS. 2, 4, and 5, 149) abuts the horizontal roller (338) also adds an additional safety feature. Specifically, an improper angle can be interpreted as a sign that there is no rider (FIG. 2, 195) being pulled behind the watercraft (FIGS. 2, 11, 12 and 13, 191). When a rider (FIG. 2, 195) falls into the water while being pulled behind the watercraft (FIG. 2, 191), the tension on the towrope (FIGS. 2, 4, and 5, 149) will slack, causing the force applied on the horizontal roller (338) to decrease to a degree insufficient to sustain the horizontal roller in a engaged position. The towrope winch (FIGS. 2, 3, and 14, 101) will then cease to operate as describe above. This safety feature further prevents injury to the rider (FIG. 2, 195) or other occupants of the watercraft (FIG. 2, 191) by eliminating the ability to reel-in or reel-out the towrope and thereby preventing the slack towrope (FIGS. 2, 4, and 5, 149) from wrapping around another object or person and reeling it or the person into the towrope winch (FIGS. 2, 3, and 14, 101).

Additionally, an improper angle may be a sign that the towrope winch (FIGS. 2, 3, and 14, 101) itself is not properly mounted onto the tower (FIGS. 1 and 2, 131). This safety feature prevents injury to the rider (FIG. 2, 195) or others on the watercraft (FIGS. 2, 11, 12 and 13, 191) by insuring that the towrope winch (FIGS. 2, 3, and 14, 101) will not fall from the tower (FIG. 2, 131) and hit someone.

Continuing on, after the ECU (FIG. 10, 170) is sent the signal from the switch (340), the ECU (FIG. 10, 170) interprets this signal to mean that none of the devices attached to the towrope winch (FIGS. 2, 3, and 14, 101) should be disengaged. However, when the circuit is broken on the switch (340), the ECU (FIG. 10, 170) is notified that the tension on the towrope (FIGS. 2, 4, and 5, 149) has gone slack. As discussed earlier, this may be indicative of the rider (FIG. 2, 195) having fallen into the water. Therefore, when tension has been released on the towrope (FIGS. 2, 4, and 5, 149), the block (336) subsequently lowers and the circuit in the switch (340) is opened. A signal is then sent to the ECU (FIG. 10, 170) notifying the ECU (FIG. 10, 170) that the tension on the towrope (FIGS. 2, 4, and 5, 149) has gone slack. The ECU (FIG. 10, 170) then signals a number of devices attached to the towrope winch (FIGS. 2, 3, and 14, 101). For example, upon deactivation of one of the switches (340), the ECU (FIG. 10, 170) causes the motor (FIGS. 4, 6, and 10, 111) to stop reeling the towrope (FIGS. 2, 4, and 5, 149) in or out, engages the brake assembly (FIGS. 3, 4, 7, 8, and 10, 120), or both. In one illustrative embodiment, after the ECU has disengaged a number of systems associated with the towrope winch (FIGS. 2, 3, and 14, 101), the user interface system (FIGS. 11 and 12, 200), the ECU (FIG. 10, 170), or any other system associated with the towrope winch (FIGS. 2, 3, and 14, 101) may send a visual or audible signal to the operator of the watercraft (FIGS. 2, 11, 12 and 13, 191) directing his attention to the problem or situation.

Figure 18:
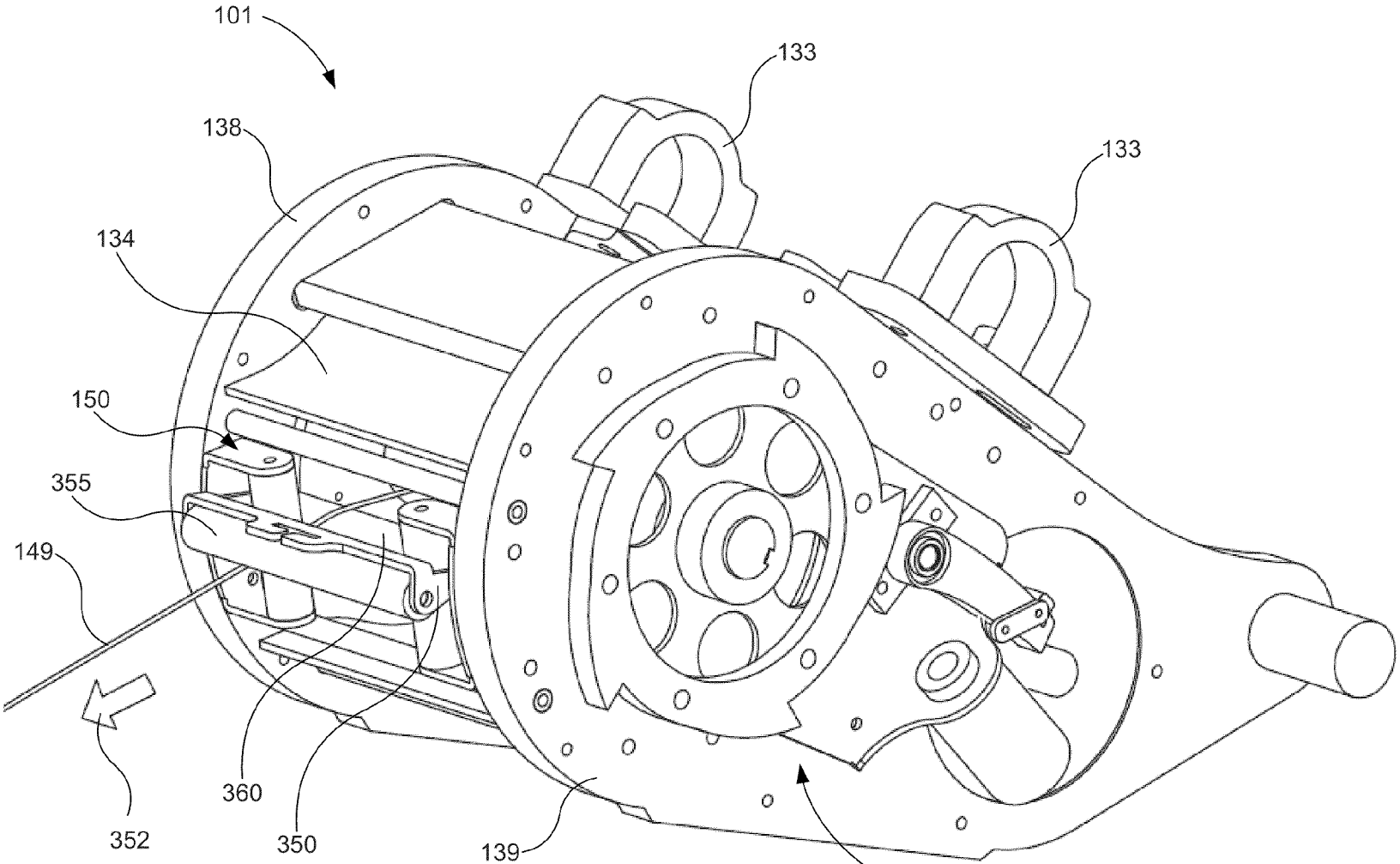
FIG. 18 is a perspective view of the towrope winch including a safety shutoff device depicted in an engaged position according to another embodiment of the present illustrative system and method.
Figure 19:
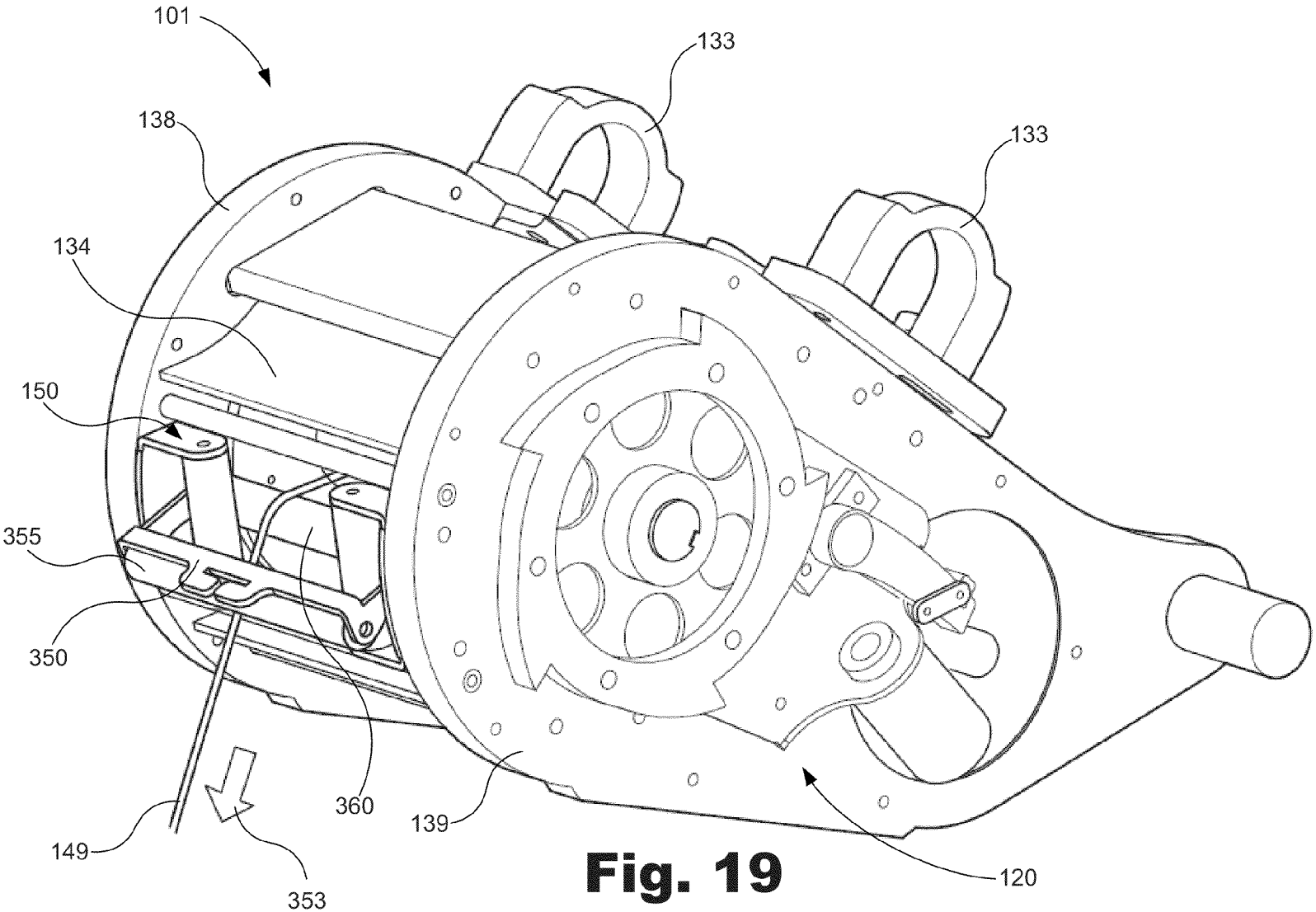
FIG. 19 is a perspective view of the towrope winch of FIG. 18 depicting the safety shutoff device in a non-engaged position according to an embodiment of the present illustrative system and method.
Figure 20:
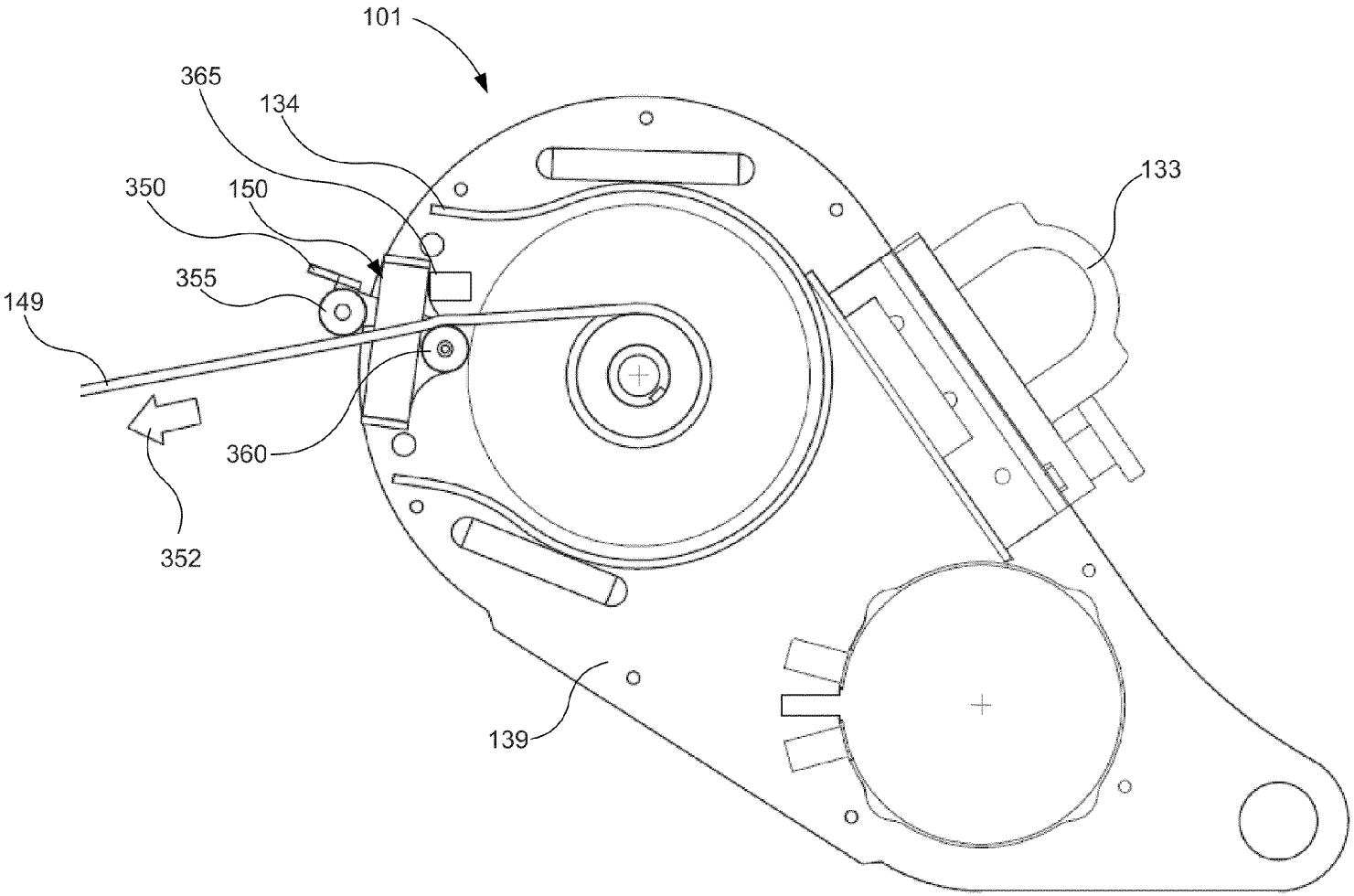
FIG. 20 is a side cutaway view of the towrope winch including the safety shutoff device of FIGS. 18 and 19 depicted in an engaged position according to an embodiment of the present illustrative system and method.
Figure 21:
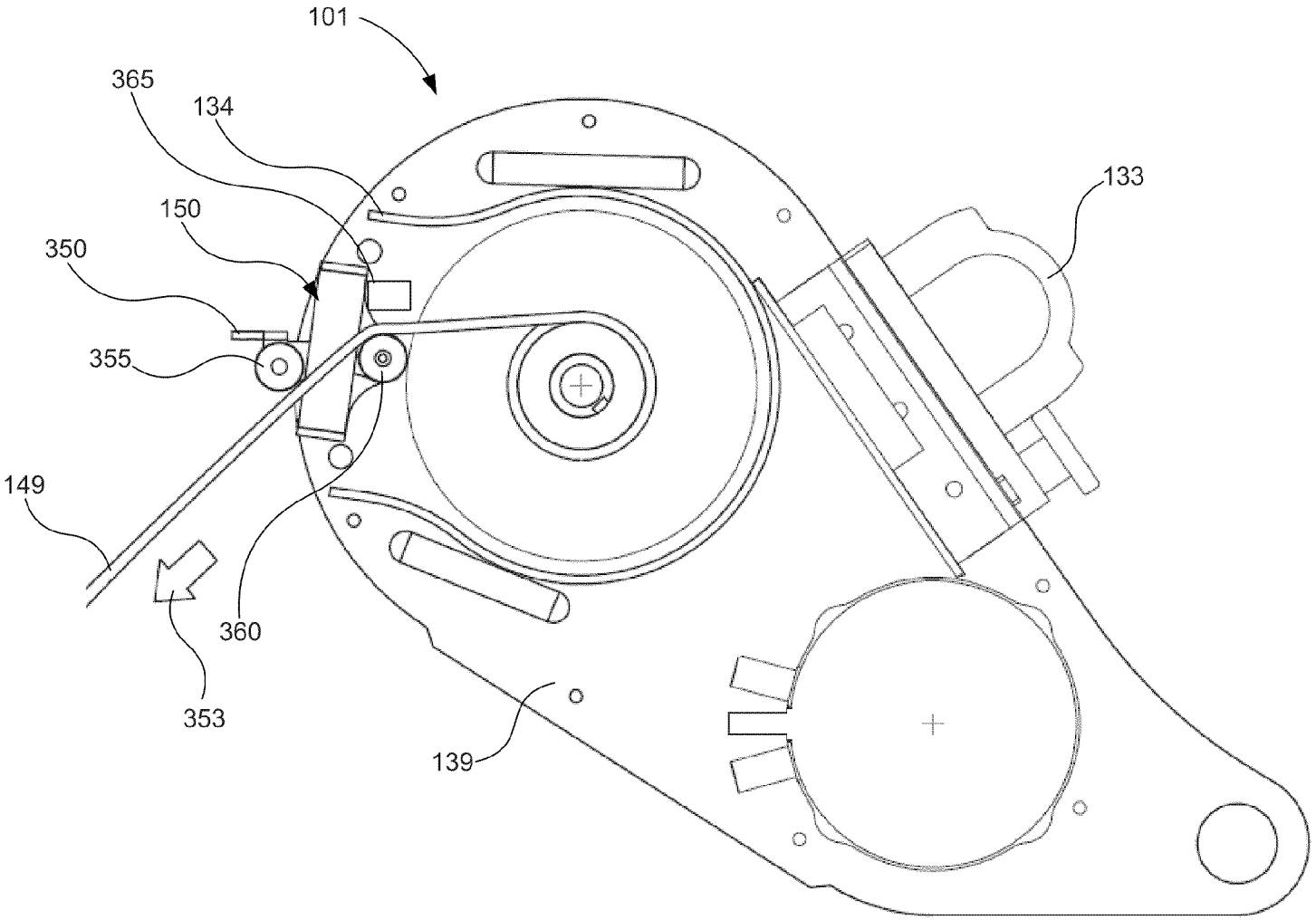
FIG. 21 is a side cutaway view of the towrope winch including the safety shutoff device of FIGS. 18 and 19 depicted in a non-engaged position according to an embodiment of the present illustrative system and method.

FIG. 18 is a perspective view of the towrope winch (101) including a safety shutoff device (365) depicted in an engaged position according to another embodiment of the present illustrative system and method. Similarly, FIG. 19 is a perspective view of the towrope winch (101) of FIG. 18 depicting the safety shutoff device (365) in a non-engaged position according to an embodiment of the present illustrative system and method. Further, FIG. 20 is a side cutaway view of the towrope winch (101) including the safety shutoff device (365) of FIGS. 18 and 19 depicted in an engaged position according to an embodiment of the present illustrative system and method. Similarly, FIG. 21 is a side cutaway view of the towrope winch (101) including the safety shutoff device (365) of FIGS. 18 and 19 depicted in a non-engaged position according to an embodiment of the present illustrative system and method.

In one embodiment, the towrope winch (FIGS. 18 through 21, 101) may a safety shutoff device (365). The safety shutoff device (365) may include a roller bracket (350), a first roller (355) coupled to the roller bracket (350), a second roller (360), and a switch (370). In another illustrative embodiment, a number of switches may be incorporated into the safety shutoff device (365). The roller bracket (350) may be directly or indirectly coupled to, for example, the motor chassis (138) and brake chassis (139). In one embodiment, the roller bracket (350) may be indirectly coupled to the motor chassis (138) and brake chassis (139) via the fairlead assembly (150). In another embodiment, the sides of the the roller bracket (350) may be directly coupled to the motor chassis (138) and brake chassis (139), respectively.

The roller bracket (350) is a rocker switch that may include a pivot point about which the roller bracket (350) pivots. Further, the roller bracket (350) may be spring biased in one direction or the other about the pivot point. In one embodiment, the roller bracket (350) is biased in the direction indicated by the arrow (353) in FIG. 19. In this manner, a force may be applied to the roller bracket (350) and first roller (355) by, for example, the towrope (FIGS. 18 through 21, 149) in the direction opposite to arrow (FIG. 19, 353), or otherwise in the direction of the arrow (352) of FIG. 18. An engaged position is achieved in this manner as depicted in FIGS. 18 and 20. When force is no longer applied by the towrope (FIGS. 18 through 21, 149), the roller bracket (350) and first roller (355) pivot back to their original position. A non-engaged position is achieved in this manner as depicted in FIGS. 19 and 21. An engaged position includes a position relative to the towrope winch (101) that renders the towrope winch operable.

The second roller (360) may be configured to remain stationary with respect to the roller bracket (350) and first roller (355). In one embodiment, the second roller (360) may remain stationary, and guide the towrope (FIGS. 18 through 21, 149) in and out of the towrope winch (101). In another embodiment, the second roller (360) may be coupled to the roller bracket (350) and first roller (355) and configured to move with the roller bracket (350) and first roller (355).

As discussed above in connection with the embodiment of FIG. 17, in one illustrative embodiment, the roller bracket (350) may be coupled to a switch (370) configured to send a signal to the ECU (FIG. 10, 170) when a predetermined or designated amount of force is exerted on the first roller (355) via tension placed on the towrope (FIGS. 18 through 21, 149). In another embodiment, the roller bracket (350) may be coupled to a switch (370) configured to send a signal to the ECU (FIG. 10, 170) when tension is applied to the first roller (355) at a predetermined or designated range of angles relative to an intake of the towrope winch (101). Still, in another embodiment, the roller bracket (350) may be coupled to a switch (370) configured to send a signal to the ECU (FIG. 10, 170) when both a predetermined or designated amount of force is exerted on the first roller (355) via tension placed on the towrope (FIGS. 18 through 21, 149), and when that force is applied to the first roller (355) at a predetermined or designated range of angles relative to an intake of the towrope winch (101). Similarly stated, the safety shutoff device (365) may be configured to deactivate the towrope winch (101) if the rope moves outside a predetermined or designated range of angles relative to an intake of the towrope winch (101).

The predetermined amount of force applied to the first roller (355) via tension placed on the towrope (FIGS. 18 through 21, 149), and in turn to the switch (370), will vary greatly depending on a number of factors. These factors may include the angle of the towrope (FIGS. 18 through 21, 149) leaving the towrope winch (101), the angle of the towrope (FIGS. 18 through 21, 149) entering the towrope winch (101), the type of hardware and materials used in that hardware, and the weight of the rider (FIG. 2, 195) among others. The force being placed on the first roller (355) is merely one way a signal can be sent to the ECU (FIG. 10, 170) confirming that operation of the towrope winch (101) should be allowed. Therefore, if force is indeed placed on the first roller (355) thereby activating the safety shutoff device (365), the ECU (FIG. 10, 170) may allow activation of the reel-out button (FIGS. 4 and 9, 163) and reel-in button (FIGS. 4 and 9, 161) based on that condition. As discussed earlier, however, this may not necessarily be the only condition to be met before the towrope winch (101) can be operated.

The predetermined or designated range of angles at which the safety shutoff device (365) may render the towrope winch (101) operable may also vary depending on a number of factors such as the vertical position of towrope winch (101), the distance from the tower (FIGS. 1 and 2, 131) to the back of the watercraft (FIG. 2, 191), the length of towrope (FIGS. 18 through 21, 149) being used, rotation of the winch as it is mounted with respect to the tower, among others. The vertex of the angle in question may be the intake of the winch on which the rope is wound. In one illustrative embodiment, the range of angles at which the safety shutoff device (365) is activated, thereby allowing operation of the towrope winch (101), can be from 0 degrees to −75 degrees if the winch is mounted on a tower extending above the watercraft and 0 degrees is considered to a horizontal line, for example, parallel to the water surface on which the watercraft is floating. One of skill in the art will appreciate that the range of angles considered as safe, i.e., indicating use of the rope outside the watercraft to tow a rider and safely away from the watercraft and its prop, can be adjusted based on a number of variables as best suits a particular applications.

In the example under discussion, the ranges of angles of the towrope (FIGS. 18 through 21, 149) exerting force on the first roller (355) is another way a signal can be sent to the ECU (FIG. 10, 170) confirming that operation of the towrope winch (101) may be allowed. This safety feature further prevents operation of the towrope winch (101) when a person inside the watercraft (FIG. 2, 191) either purposefully or accidentally exerts tension on the towrope (FIGS. 18 through 21, 149). Because the person would be standing from the deck of the boat when the tension is applied, the angle created by the towrope (FIGS. 18 through 21, 149) between the person and the towrope winch (101) exceeds the threshold of allowable angles at which the shutoff switch (365) will indicate to the ECU (FIG. 10, 170) that operation of the towrope winch (101) is allowed. Therefore, injury to the person will not occur because the towrope winch (101) will not be activated.

In one illustrative embodiment, the allowable angle can be adjusted. This allows a user to adjust the allowable angles so that the rider (FIG. 2, 195) is not allowed to reel-in the towrope (FIGS. 18 through 21, 149) too close to the watercraft (FIG. 2, 191). This prevents the rider (FIG. 2, 195) from accidentally reeling in the towrope (FIGS. 18 through 21, 149) to the point where he or she can be injured by the watercraft (FIG. 2, 191).

The angle at which the towrope (FIGS. 18 through 21, 149) abuts the first roller (355) also adds an additional safety feature. Specifically, an improper angle can be interpreted as a sign that there is no rider (FIG. 2, 195) being pulled behind the watercraft (FIGS. 2, 191). When a rider (FIG. 2, 195) falls into the water while being pulled behind the watercraft (FIG. 2, 191), the tension on the towrope (FIGS. 18 through 21, 149) will slack, causing the force applied on the first roller (355) to decrease to a degree insufficient to sustain the first roller (355) and roller bracket (350) of the safety shutoff device (365) in a engaged position. The towrope winch (FIGS. 2, 3, and 14, 101) will then cease to operate as describe above. This safety feature further prevents injury to the rider (FIG. 2, 195) or other occupants of the watercraft (FIG. 2, 191) by eliminating the ability to reel-in or reel-out the towrope and thereby preventing the slack towrope (FIGS. 18 through 21, 149) from wrapping around another object or person and reeling it or the person into the towrope winch (101).

Additionally, an improper angle may be a sign that the towrope winch (101) itself is not properly mounted onto the tower (FIGS. 1 and 2, 131). This safety feature prevents injury to the rider (FIG. 2, 195) or others on the watercraft (FIG. 2, 191) by insuring that the towrope winch (101) will not fall from the tower (FIG. 2, 131) and hit someone.

Continuing on, after the ECU (FIG. 10, 170) is sent the signal from the switch (370), the ECU (FIG. 10, 170) interprets this signal to mean that a rider (FIG. 2, 195) is appropriately applying tension on the towrope (FIGS. 18 through 21, 149), that the safety shutoff device (365) is engaged, and that none of the devices or sub-assemblies attached to the towrope winch (101) should be disengaged. However, when the circuit is broken on the switch (370), the ECU (FIG. 10, 170) is notified that the tension on the towrope (FIGS. 18 through 21, 149) has gone slack. As discussed earlier, this may be indicative of the rider (FIG. 2, 195) having fallen into the water. Therefore, when tension has been released on the towrope (FIGS. 18 through 21, 149), the roller bracket (350) and first roller (355) of the safety shutoff device (365) subsequently lower, and disengage with the switch (370). A signal may then be sent to the ECU (FIG. 10, 170) notifying the ECU (FIG. 10, 170) that the tension on the towrope (FIGS. 18 through 21, 149) has gone slack. The ECU (FIG. 10, 170) then signals a number of devices attached to the towrope winch (101). For example, upon disengagement of the safety shutoff device (365), the ECU (FIG. 10, 170) causes the motor (FIGS. 4, 6, and 10, 111) to stop reeling the towrope (FIGS. 18 through 21, 149) in or out, engages the brake assembly (FIGS. 3, 4, 7, 8, and 10, 120), and renders the user interface system (FIGS. 11 and 12, 200) inoperable, among other actions. In one illustrative embodiment, after the ECU has disengaged a number of systems associated with the towrope winch (101), the user interface system (FIGS. 11 and 12, 200), the ECU (FIG. 10, 170), or any other system associated with the towrope winch (101) may send a visual, tactile, or audible signal to the operator of the watercraft (FIG. 2, 191) directing his attention to the problem or situation.

Figure 22:
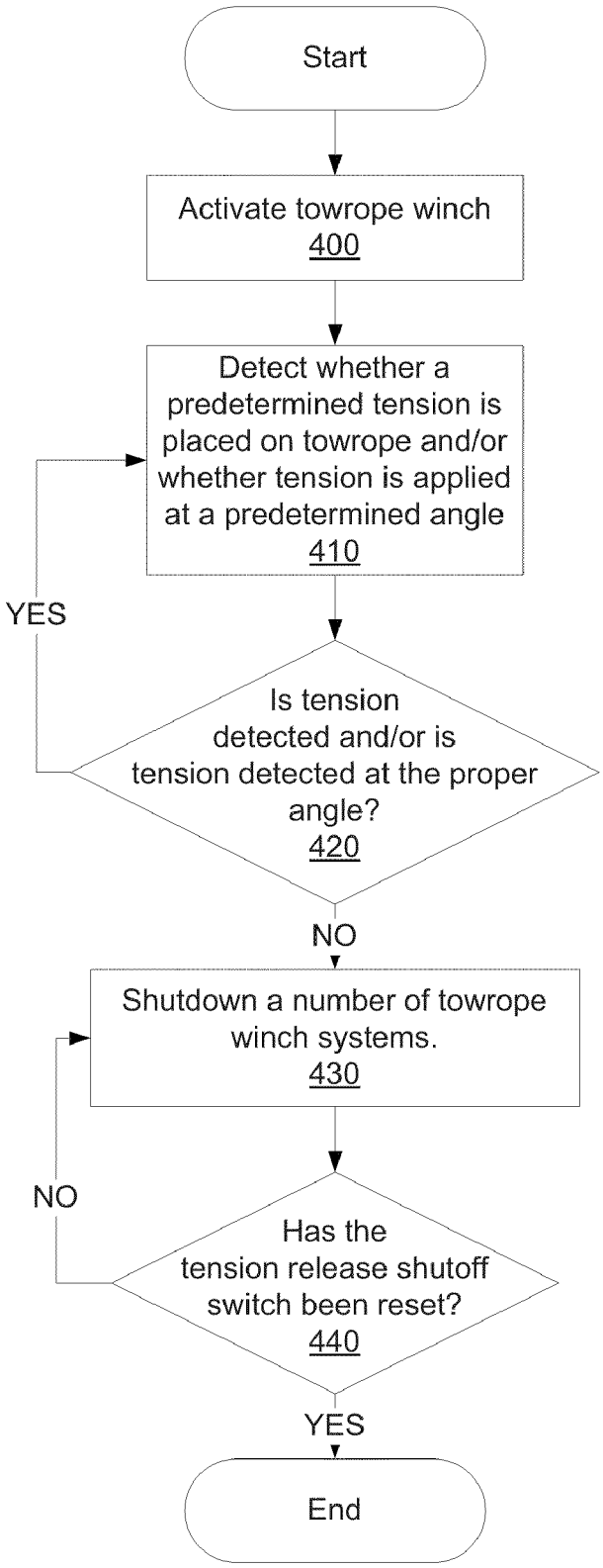
FIG. 22 is a flowchart illustrating an illustrative method of using a safety shutoff device according to an embodiment of the present illustrative system and method.

FIG. 22 is a flowchart illustrating an illustrative method of using a safety shutoff device according to an embodiment of the present illustrative system and method. The process begins with the user activating the towrope winch (FIGS. 2, 3, and 14, 101) (Step 400). This may be performed by accessing a user interface system (FIGS. 11, 12, and 13, 200) in order to turn on the towrope winch (FIGS. 2, 3, and 14, 101) as discussed above.

Next, the safety shutoff device (FIGS. 18, 19, 20, and 21, 365) detects whether or not tension is being applied to the towrope (FIGS. 2, 4, and 5, 149) (Step 410). As discussed above, this is done by detecting whether the towrope (FIGS. 2, 4, and 5, 149) is applying force against the first roller (FIGS. 18, 19, 20, and 21, 355). Application of tension against the first roller (FIGS. 18, 19, 20, and 21, 355) displaces the roller bracket (FIGS. 18, 19, 20, and 21, 350). This, in turn, activates a number of switches (FIGS. 18, 19, 20, and 21, 370). Therefore, in an illustrative embodiment, the safety shutoff device (FIGS. 18, 19, 20, and 21, 365), and, more specifically, the switches (FIGS. 18, 19, 20, and 21, 370) send a signal to the ECU (FIG. 10, 170) notifying the ECU (FIG. 10, 170) that tension is being placed on the towrope (FIGS. 2, 4, and 5, 149). This, therefore, indicates to the system that a rider (FIG. 2, 195) is on the towrope (FIGS. 2, 4, and 5, 149) or otherwise being pulled by the watercraft (FIGS. 2, 11, 12 and 13, 191).

When the safety shutoff device (FIGS. 18, 19, 20, and 21, 365) has detected that tension is being placed on the towrope winch (FIGS. 18, 19, 20, and 21, 101), it then allows the towrope winch (FIGS. 18, 19, 20, and 21, 101) to operate as indicated above. However, if tension on the towrope (FIGS. 2, 4, and 5, 149) is not detected, or if that the towrope (FIGS. 2, 4, and 5, 149) moves outside a designated range of angles relative to the towrope winch (FIGS. 18, 19, 20, and 21, 101), then the safety shutoff device (FIGS. 18, 19, 20, and 21, 365), and, more specifically, the switches (FIGS. 18, 19, 20, and 21, 370) send a signal to the ECU (FIG. 10, 170) which then shuts down a number of towrope winch (FIGS. 18, 19, 20, and 21, 101) systems and/or sub-systems (Step 430). As discussed above, the ECU (FIG. 10, 170) may either shut of the motor (FIGS. 4 and 6, 111), engage the brake assembly (FIGS. 3, 4, 7, 8, and 10, 120), or both. Additionally, the ECU (FIG. 10, 170) may deactivate or otherwise stop receiving instructions from the user interface system (FIGS. 11, 12, and 13, 200).

Therefore, once the safety shutoff device (FIGS. 18, 19, 20, and 21, 365) has detected that tension is not being placed on the towrope (FIGS. 2, 4, and 5, 149) or that the towrope (FIGS. 2, 4, and 5, 149) moves outside a designated range of angles relative to the towrope winch (FIGS. 18, 19, 20, and 21, 101), (Step 420) and a number of towrope winch (FIGS. 2, 3, and 14, 101) systems have been deactivated or shutdown (Step 430), the user may be prompted to reset the system (Step 440) or otherwise address the problem with the safety shutoff device (FIGS. 18, 19, 20, and 21, 365). For example, if a rider (FIG. 2, 195) falls down in the water and the tension once placed on the towrope (FIGS. 2, 4, and 5, 149) by the rider (FIG. 2, 195) is not present, the ECU (FIG. 10, 170) will shut down a number of towrope winch (FIGS. 2, 3, and 14, 101) systems. In one embodiment, a user may then have to reset the system (Step 440) before the towrope winch (FIGS. 2, 3, and 14, 101) will be allowed to operate once again.

In another illustrative embodiment, a user may not need to reset the system, by, for example, interacting with a user interface system (FIGS. 11, 12, and 13, 200) as described above, but instead, the safety shutoff device (FIGS. 18, 19, 20, and 21, 365) need only detect tension placed on the towrope (FIGS. 2, 4, and 5, 149) once again. This would then send a signal to the ECU (FIG. 10, 170) as explained above, and the ECU (FIG. 10, 170) would then allow the towrope winch (FIGS. 2, 3, and 14, 101) to be operated once again.

In another illustrative embodiment, the safety shutoff device (FIGS. 18, 19, 20, and 21, 365) detects whether or not tension is being applied to the towrope (FIGS. 2, 4, and 5, 149) (Step 410) at a predetermined angle. As discussed above, this is done by detecting whether the towrope (FIGS. 2, 4, and 5, 149) is applying force against a first roller (FIGS. 18, 19, 20, and 21, 355) at a designated range of angles relative to an intake of the towrope winch (FIGS. 2, 3, and 14, 101). Application of force against the first roller (FIGS. 18, 19, 20, and 21, 355) at a predetermined angle or designated range of angles displaces roller bracket (FIGS. 18, 19, 20, and 21, 350). This in turn activates switch (FIGS. 18, 19, 20, and 21, 370). Therefore, in an illustrative embodiment, the safety shutoff device (FIGS. 18, 19, 20, and 21, 365), and, more specifically, the switch (FIGS. 18, 19, 20, and 21, 370) sends a signal to the ECU (FIG. 10, 170) notifying the ECU (FIG. 10, 170) that tension at a proper angle is being applied to the first roller (FIGS. 18, 19, 20, and 21, 355). This, therefore, indicates to the system that a rider (FIG. 2, 195) is placing tension on the towrope (FIGS. 2, 4, and 5, 149) from behind the watercraft (FIGS. 2, 11, 12 and 13, 191).

When the safety shutoff device (FIGS. 18, 19, 20, and 21, 365) has detected that tension at a proper angle is being applied to the first roller (FIGS. 18, 19, 20, and 21, 355), it then allows the towrope winch (FIGS. 2, 3, and 14, 101) to operate as indicated above. However, if an improper angle of force on the first roller (FIGS. 18, 19, 20, and 21, 355) is not detected, then the safety shutoff device (FIGS. 18, 19, 20, and 21, 365), and, more specifically, the switch (FIGS. 18, 19, 20, and 21, 370) sends a signal to the ECU (FIG. 10, 170) which then shuts down a number of towrope winch (FIGS. 2, 3, and 14, 101) systems (Step 430). As discussed above, the ECU (FIG. 10, 170) may either shut of the motor (FIGS. 4 and 6, 111), engage the brake assembly (FIGS. 3, 4, 7, 8, and 10, 120), or both. Additionally, the ECU (FIG. 10, 170) may deactivate or otherwise stop receiving instructions from the user interface system (FIGS. 11, 12, and 13, 200).

Therefore, once the safety shutoff device (FIGS. 18, 19, 20, and 21, 365) has detected that force is not being placed on the first roller (FIGS. 18, 19, 20, and 21, 355) at a proper angle (Step 420) and a number of towrope winch (FIGS. 2, 3, and 14, 101) systems have been deactivated or shutdown (Step 430), the user may be prompted to reset the system (Step 440) or otherwise address the problem with the safety shutoff device (FIGS. 18, 19, 20, and 21, 365). For example, if a rider (FIG. 2, 195) falls down in the water and the angle of force once placed on the first roller (FIGS. 18, 19, 20, and 21, 355) by the towrope (FIGS. 2, 4, and 5, 149) is not present, the ECU (FIG. 10, 170) will shut down a number of towrope winch (FIGS. 2, 3, and 14, 101) systems. A user will then have to reset the system (Step 440) before the towrope winch (FIGS. 2, 3, and 14, 101) will be allowed to operate once again.

In yet another illustrative embodiment, the safety shutoff device (FIGS. 18, 19, 20, and 21, 365) detects whether or not tension is being applied to the towrope (FIGS. 2, 4, and 5, 149) (Step 410) and that that tension is being applied at a designated range of angles relative to an intake of the winch. As discussed above, this is done by detecting whether the towrope (FIGS. 2, 4, and 5, 149) is applying force against the first roller (FIGS. 18, 19, 20, and 21, 355) and that that force is being exerted onto the first roller (FIGS. 18, 19, 20, and 21, 355) within a designated range of angles. Application of force against first roller (FIGS. 18, 19, 20, and 21, 355) displaces the roller bracket (FIGS. 18, 19, 20, and 21, 350). This in turn activates the switch (FIGS. 18, 19, 20, and 21, 370). Therefore, in an illustrative embodiment, the safety shutoff device (FIGS. 18, 19, 20, and 21, 365), and, more specifically, the switch (FIGS. 18, 19, 20, and 21, 370) sends a signal to the ECU (FIG. 10, 170) notifying the ECU (FIG. 10, 170) that force is being placed on the first roller (FIGS. 18, 19, 20; and 21, 355) and that that force is being placed on the first roller (FIGS. 18, 19, 20, and 21, 355) within a designated range of angles. This, therefore, indicates to the system that a rider (FIG. 2, 195) is placing tension on the towrope (FIGS. 2, 4, and 5, 149) from behind the watercraft (FIG. 2, 191).

When the safety shutoff device (FIGS. 18, 19, 20, and 21, 365) has detected that force is being placed on the first roller (FIGS. 18, 19, 20, and 21, 355) and that that force is applied inside a designated range of angles, it then allows the towrope winch (FIGS. 2, 3, and 14, 101) to operate as indicated above. However, if tension on the towrope (FIGS. 2, 4, and 5, 149) is not detected, or if the rope moves outside a designated range of angles, then the safety shutoff device (FIGS. 18, 19, 20, and 21, 365), and, more specifically the switch (FIGS. 18, 19, 20, and 21, 370) sends a signal to the ECU (FIG. 10, 170) which then shuts down a number of towrope winch (FIGS. 2, 3, and 14, 101) systems (Step 430). As discussed above, the ECU (FIG. 10, 170) may either shut of the motor (FIGS. 4 and 6, 111), engage the brake assembly (FIGS. 3, 4, 7, 8, and 10, 120), or both. Additionally, the ECU (FIG. 10, 170) may deactivate or otherwise stop receiving instructions from the user interface system (FIGS. 11, 12, and 13, 200).

The preceding description has been presented only to illustrate and describe embodiments of the invention. It is not intended to be exhaustive or to limit the invention to any precise form disclosed. Many modifications and variations are possible in light of the above teaching.

What is claimed is:

1. A towrope winch with a safety shutoff device comprising:

a winch configured to wind a rope; and a safety shutoff device which deactivates the winch if the rope moves outside a designated range of angles relative to an intake of the winch;

in which the safety shutoff device comprises a light curtain for determining an angle at which said rope extends relative to an intake of the winch.

2. The towrope winch with a safety shutoff device of claim 1, in which the safety shutoff device deactivates the winch if the angle of the rope relative to the intake of the winch indicates that the rope is under tension from inside a watercraft on which the winch is located.

3. The towrope winch with a safety shutoff device of claim 1, in which the safety shutoff device enables operation of the winch if the angle of the rope relative to the intake of the winch indicates that the rope is under tension from outside a watercraft on which the winch is located.

4. The towrope winch with a safety shutoff device of claim 1, in which the safety shutoff device comprises a slider which is moved by the rope to activate or deactivate the winch depending on the angle of the rope relative to an intake of the winch.

5. The towrope winch with a safety shutoff device of claim 4, in which the slider closes a circuit to provide power to the winch if the rope is under tension and extending within said designated range of angles relative to an intake of the winch.

6. A towrope winch with a safety shutoff device comprising:

a winch configured to wind a rope; and a safety shutoff device which deactivates the winch if the rope moves outside a designated range of angles relative to an intake of the winch;

in which the safety shutoff device comprises a slider which is moved by the rope to activate or deactivate the winch depending on the angle of the rope relative to an intake of the winch;

in which the slider closes a circuit to provide power to the winch if the rope is under tension and extending within said designated range of angles relative to an intake of the winch;

in which the slider moves downward under influence of gravity to open said circuit if not moved by the rope.

7. A towrope winch with a safety shutoff device comprising:

a winch configured to wind a rope; and a safety shutoff device which deactivates the winch if the rope moves outside a designated range of angles relative to an intake of the winch;

in which the safety shutoff device comprises a slider which is moved by the rope to activate or deactivate the winch depending on the angle of the rope relative to an intake of the winch;

in which the slider further comprise a roller for engaging the towrope.

8. The towrope winch with a safety shutoff device of claim 1, in which the safety shutoff device comprises a biased switch which is actuated by the rope depending on the angle of the rope relative to an intake of the winch so as to activate or deactivate the winch.

9. The towrope winch of claim 1, in which the designated range of angles includes a range of angles from 0 degrees to −75 degrees, with 0 degrees being parallel to a water surface on which a watercraft bearing said winch is floating.

10. The towrope winch of claim 1, in which the safety shutoff device deactivates the winch if a designated amount of tension is not applied to the rope.

11. A method of operating a towrope winch with a safety shutoff device, where the winch is configured to wind a rope, the method comprising;

with the safety shutoff device, deactivating the winch if the rope moves outside a designated range of angles relative to an intake of the winch;

in which the designated range of angles includes a range of angles from 0 degrees to −75 degrees, with 0 degrees being parallel to a water surface on which a watercraft bearing said winch is floating.

12. The method of claim 11, in which the safety shutoff device deactivates the winch if the angle of the rope relative to the intake of the winch indicates that the rope is under tension from inside a watercraft on which the winch is located.

13. The method of claim 11, in which the safety shutoff device enables operation of the winch if the angle of the rope relative to the intake of the winch indicates that the rope is under tension from outside a watercraft on which the winch is located.

14. The method of claim 11, further comprising towing a board rider with a watercraft to which said winch is mounted, said board rider holding said rope.

15. The method of claim 11, further comprising moving a slider with the rope to activate or deactivate the winch depending on the angle of the rope relative to an intake of the winch.

16. The method of claim 15, in which the slider closes a circuit to provide power to the winch if the rope is under tension and extending within said designated range of angles relative to an intake of the winch.

17. The method of claim 11, in which the safety shutoff device comprises a biased switch which is actuated by the rope depending on the angle of the rope relative to an intake of the winch so as to activate or deactivate the winch.

18. A towrope winch with a safety shutoff device comprising:

a winch configured to wind a towrope; and a safety shutoff device which makes a determination of whether a handle on said towrope is in or outside a watercraft on which said winch is disposed, said safety shutoff device deactivates the winch if said handle is determined to be inside said watercraft.

19. The towrope winch with a safety shutoff device of claim 18, in which said safety shutoff device deactivates the winch if the rope moves outside a designated range of angles relative to an intake of the winch indicating that said handle is outside said watercraft.

* * * * *